US007300365B2

(12) United States Patent
Taylor

(10) Patent No.: US 7,300,365 B2
(45) Date of Patent: Nov. 27, 2007

(54) ASSEMBLY FOR TRAINING HAND/EYE COORDINATION

(76) Inventor: Bradford Carter Taylor, 16715 Holly Trail Dr., Houston, TX (US) 77058

( * ) Notice: Subject to any disclaimer, the term of this patent is extended or adjusted under 35 U.S.C. 154(b) by 0 days.

(21) Appl. No.: 11/295,039

(22) Filed: Dec. 5, 2005

(65) Prior Publication Data

US 2007/0129182 A1 Jun. 7, 2007

(51) Int. Cl.
*A63B 69/00* (2006.01)

(52) U.S. Cl. ..... 473/451; 473/422; 473/453

(58) Field of Classification Search ..... 473/451, 473/453, 422–430, 454, 417, 419; 434/247; 482/148, 109, 118, 122

See application file for complete search history.

(56) References Cited

U.S. PATENT DOCUMENTS 3,475,026 A * 10/1969 Cooper ..... 473/430
3,937,464 A 2/1976 Zalewski
3,940,131 A 2/1976 St. Claire, Jr.
3,948,517 A * 4/1976 Feiler ..... 473/429
4,451,036 A * 5/1984 Sinclair et al. ..... 473/453
4,516,771 A * 5/1985 Nau ..... 473/453
4,620,701 A * 11/1986 Mojden ..... 482/41
4,655,452 A * 4/1987 Huerstel ..... 473/453
4,783,070 A * 11/1988 Bauer et al. ..... 473/453
5,087,039 A 2/1992 Laseke
5,226,645 A * 7/1993 Stewart ..... 473/453
5,352,170 A * 10/1994 Condo et al. ..... 482/83
5,478,070 A 12/1995 Morrison
5,485,993 A * 1/1996 Lipsett ..... 473/448
5,711,726 A * 1/1998 Powers ..... 473/453
6,113,265 A * 9/2000 Babler ..... 378/197
6,256,374 B1 * 7/2001 Tomasetti et al. ..... 378/98.2
6,435,990 B1 8/2002 Bradley
6,695,270 B1 * 2/2004 Smed ..... 248/274.1
7,056,237 B2 * 6/2006 Slavey et al. ..... 473/433
2003/0220177 A1 11/2003 Orlando
2004/0121861 A1 6/2004 Constant
2006/0089212 A1 * 4/2006 Marchel ..... 473/422
2006/0148597 A1 * 7/2006 Pope et al. ..... 473/453
2006/0240917 A1 * 10/2006 Campbell et al. ..... 473/453

* cited by examiner

*Primary Examiner*—Mitra Aryanpour
(74) *Attorney, Agent, or Firm*—Scott D. Compton

(57) ABSTRACT

An assembly for training the hand/eye coordination of an individual. The assembly comprises an unobstructed region where an individual maneuvers a training member through the unobstructed region.

17 Claims, 11 Drawing Sheets

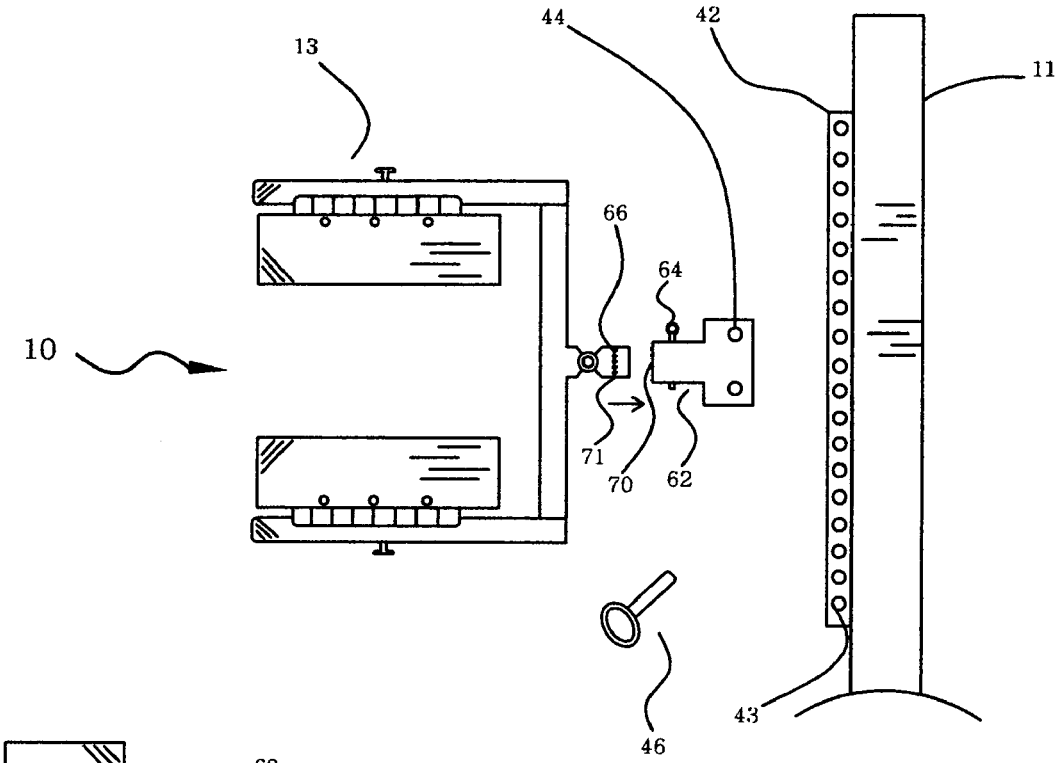
FIG 11A
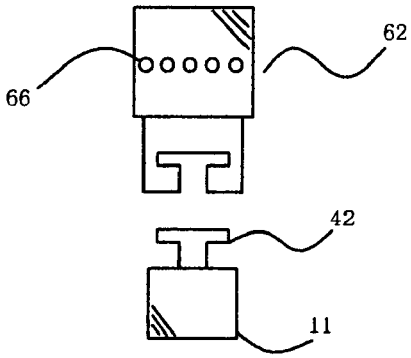
FIG 11B
FIG. 11

ASSEMBLY FOR TRAINING HAND/EYE COORDINATION

FIELD OF THE APPLICATION

The application relates generally to an assembly for training hand/eye coordination.

BACKGROUND

Hand/eye coordination is an important characteristic in athletics and other physical activities, whether it involves hitting a ball with a bat or hitting the head of a nail with a hammer. A key ingredient for developing hand/eye coordination lies in a person's vision. For instance, vision is the primary signal that causes a baseball player to swing a bat at a moving ball at a specific time and location during the ball's delivery.

A common technique for training hand/eye coordination, especially in athletics, involves repetitive physical movements performed in real time. For instance, golfers develop their ball striking ability by striking golf balls with golf clubs, in like manner as when they are playing a round of golf. Likewise, baseball players hit thrown baseballs during batting practice in an attempt to improve hand/eye coordination for contacting the center of the baseball bat to the center of a thrown baseball.

It is often difficult to measure improvement in hand/eye coordination for activities such as those mentioned above. For instance, one may consistently hit a baseball during practice, but may not actually be consistently hitting the ball at its center or "sweet spot." An assembly, or device is needed that trains hand/eye coordination and provides feedback to the user indicating success or failure for improvement in hand/eye coordination.

SUMMARY

An assembly for training hand/eye coordination. The assembly comprises a fastening member for connecting to a support; and an extension member connected to the fastening member. The extension member comprises at least two arms defining a training zone, wherein the angle of at least one arm relative to said support is adjustable.

BRIEF DESCRIPTION OF THE FIGURES

FIG. 11A illustrates a side view of at least a seventh embodiment of the assembly.

FIG. 11B illustrates a top view of the adjustment spine and junction member.

BRIEF DESCRIPTION

Figure 1:
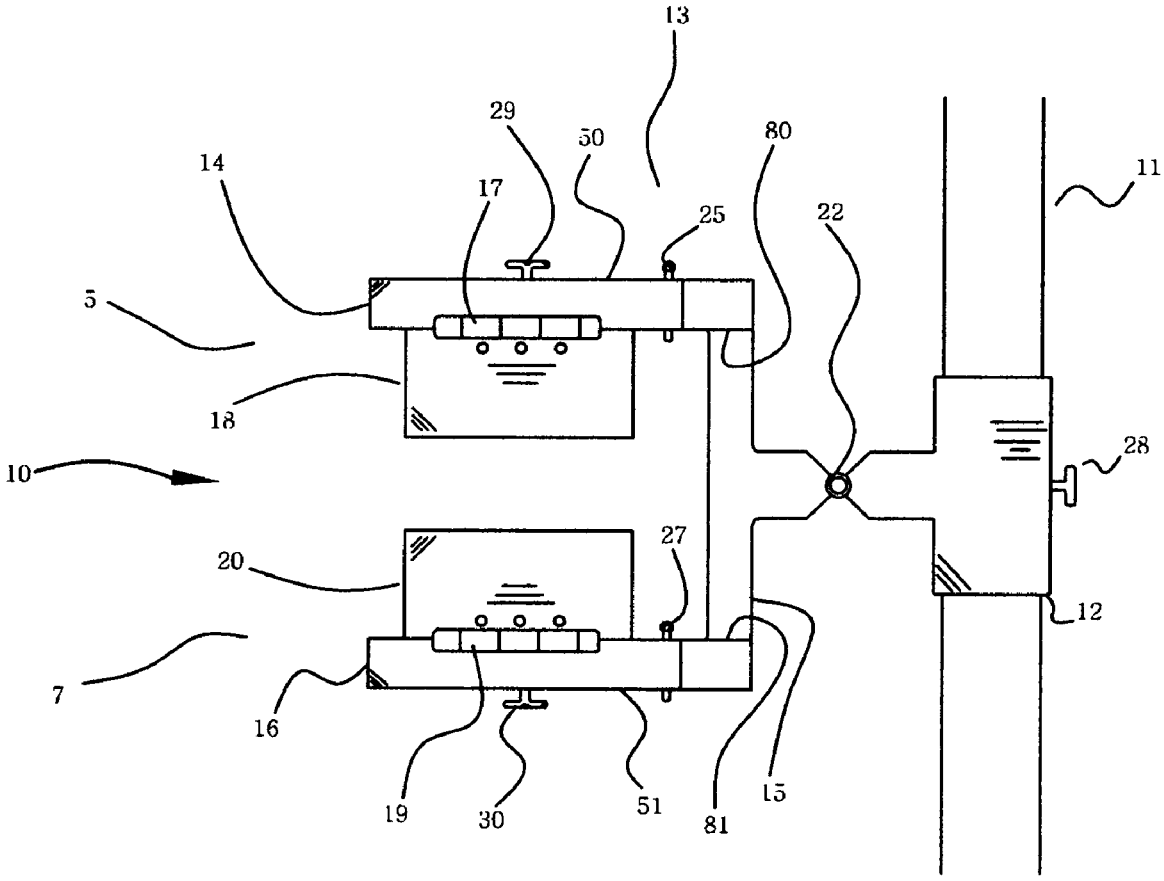
FIG. 1 illustrates a side view of at least a first embodiment of the assembly.

The present application relates to an assembly for training hand/eye coordination of an individual. The assembly is configured to be positioned at various heights and manipulated and/or adjusted to define a training zone so that hand held objects ("training members") can be maneuvered or swung through the training zone—the idea being to avoid contacting the training member to the assembly.

In addition, the assembly is configured to provide feedback indicating success or failure of improvement in hand/eye coordination as indicated by contact, or lack of, between the training member and the assembly during operation. The assembly can also comprise wear resistant features to minimize the effects of contact between the assembly and the training member.

In a particularly advantageous embodiment, the assembly comprises at least an adjustable extension member configured to (1) project out from a fastening member that is connected to a support, and (2) define a training zone between various parts of the extension member. The extension member comprises at least two arms, or in the alternative, at least two arms each further comprising at least one flap connected to each arm.

Suitably, the angle of at least one of the arms of the extension member relative to the support is adjustable. In addition, at least one of the arms can be manipulated along planes X, Y, and Z relative to the support to (a) vary the height, length, width and shape of the training zone, and (b) vary the angle of entry/exit of the training zone for passage of a training member. Thus, at least one arm of the extension member can be moved from a first position relative to the support to a second position relative to the support to define at least a second training zone.

The assembly according to the present application will be described in more detail with reference to the embodiments illustrated in the drawings. The drawings are illustrative only, and are not to be construed as limiting the assembly, which is defined in the claims.

The Assembly

In a first non-limiting embodiment shown in FIG. 1, the assembly 10 comprises a fastening member, herein referred to as housing 12 for fastening or otherwise connecting the assembly 10 to support 11 and to position assembly 10 at variable heights or points along support 11. The housing 12 exemplified in FIG. 1 is a collar type fastener defined by an opening there through that is configured to contact and fasten to or around support 11. Suitable supports 11 used with housing 12 of FIG. 1, include but are not necessarily limited to vertical, horizontal and diagonal posts, poles, stakes, bollards, tree trunks, tree limbs, walls, fencing, and doors relative to the ground or floor.

Figure 2:
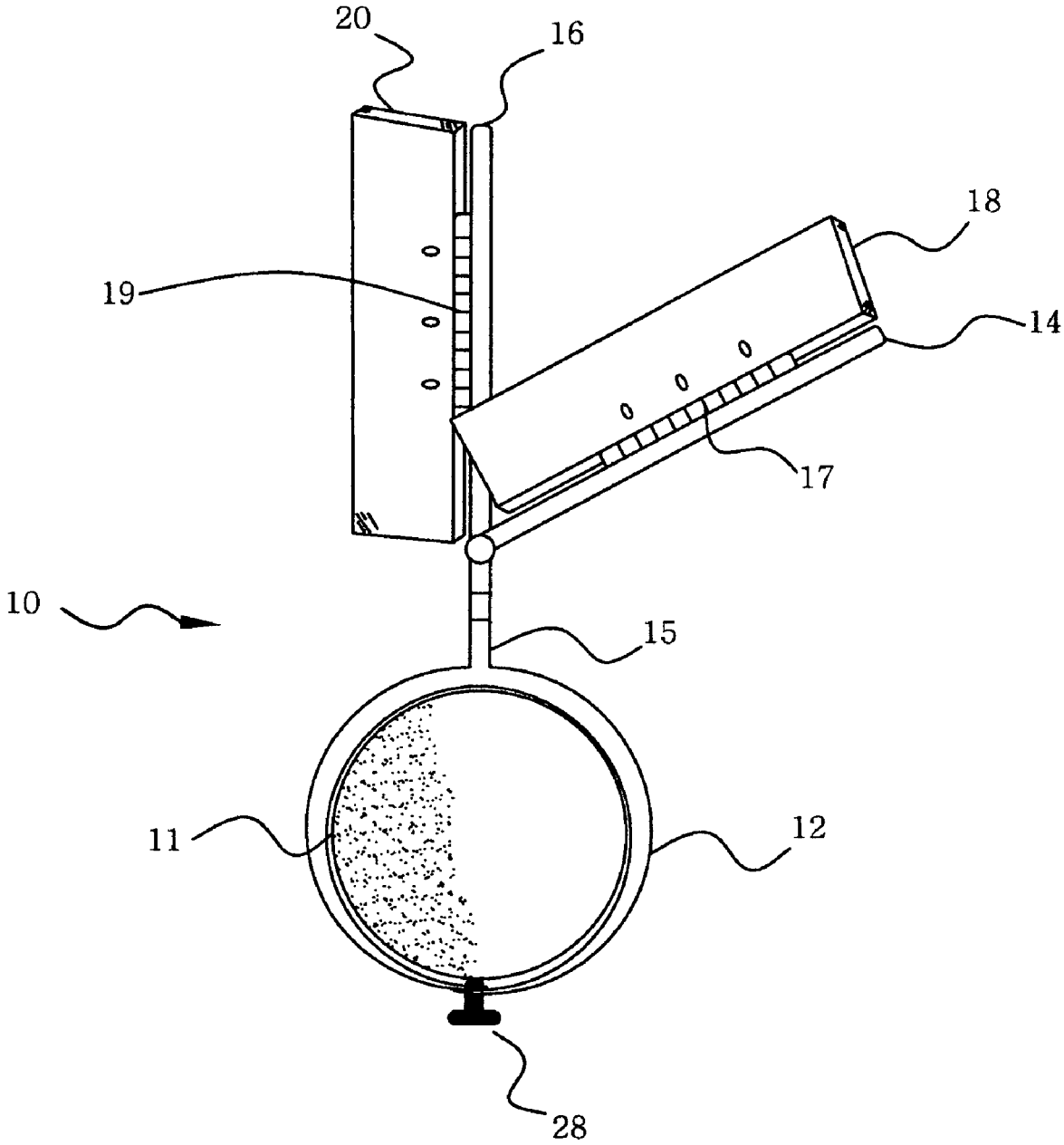
FIG. 2 illustrates a top view of the first embodiment of the assembly.

The inner configuration of housing 12 can comprise any shape or design suitable to contact and securely fasten to support 11. In at least a first embodiment, the inner configuration of housing 12 correlates to the outer configuration of support 11. For example, where support 11 is a round pole or post, housing 12 comprises a round inner configuration that wraps around and contacts support 11 (as shown in FIGS. 1 and 2).

In one embodiment, housing 12 can be a continuous piece slidable onto support 11. In the alternative, as shown in FIG. 2, housing 12 can comprise two overlapping edges wherein housing 12 can be wrapped around support 11. Here, housing 12 further comprises tightening member 28 configured to both tighten and loosen housing 12 to and from support 11. As tightening member 28 is loosened, assembly 10 can be completely removed from support 11 or otherwise adjusted along the length of support 11 and refastened at an alternate point along support 11. For example, where support 11 is a pole standing vertically relative to the ground or floor, housing 12 can be loosened from support 11 and assembly 10 can be adjusted up or down along support 11, thereby changing the height of assembly 10 for a particular individual. Herein, tightening member 28 includes but is not necessarily limited to a swivel nut with a compression clamp, an adjustment bolt, a belt, a VELCRO® fastening system and other clamp fastening systems.

As shown in FIG. 1, assembly 10 comprises an extension member 13 that projects out from housing 12. Extension member 13 comprises a T member 15 for attaching extension member 13 to housing 12. Extension member 13 also comprises at least two zone guides 5 and 7 which project out from T member 15 away from support 11 and are configured to define a training zone. Herein, the training zone can be defined as an unobstructed region formed between zone guides 5 and 7 that comprises arms 14 and 16 alone or a combination of arms 14 and 16 and flaps 18 and 20, as discussed below.

Suitably, T member 15 is connected or otherwise attached to housing 12 via an adjustable connection herein referred to as a pivot joint 22 that allows extension member 13 to pivot along the X and Y axis or rotate about pivot joint 22 relative to housing 12. The pivoting of extension member 13 allows adjusting of zone guides 5 and 7 relative to housing 12. Pivot joint 22 allows for pivoting of extension member 13 up to 270°0 along the X and Y axis. A suitable pivot 22 joint herein includes but is not necessarily limited to a rotary tongue and groove, and other suitable pivotable and rotable joints known in the art.

The greater the length of T member 15, the greater the distance between zone guides 5 and 7. As stated above, T member 15 can be attached to housing 12 via pivot joint 22, or, T member 15 can be non-pivotally attached to housing 12, thereby fixing the orientation of extension member 13 relative to housing 12.

Figure 3A:
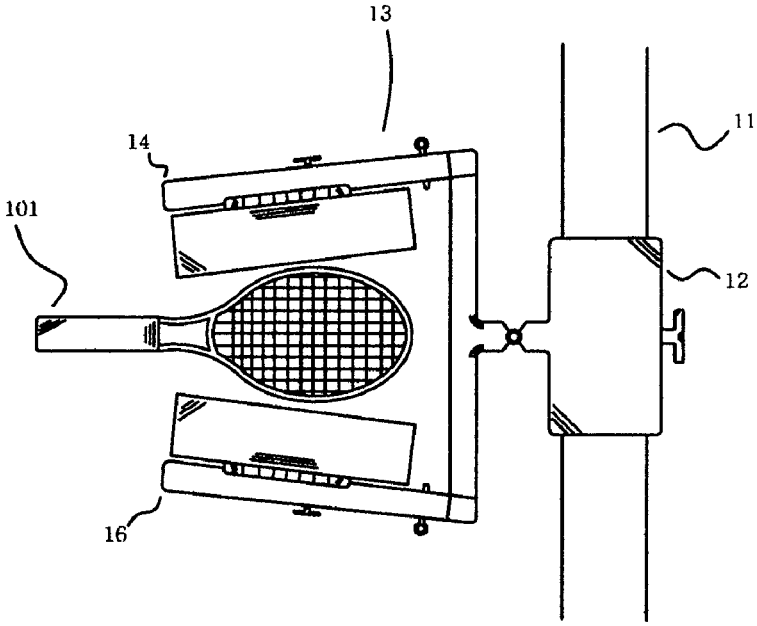
FIG. 3A illustrates a side view of the first embodiment of the assembly wherein the arms of the assembly are in non-parallel arrangement to accommodate a tennis racket.
Figure 3B:
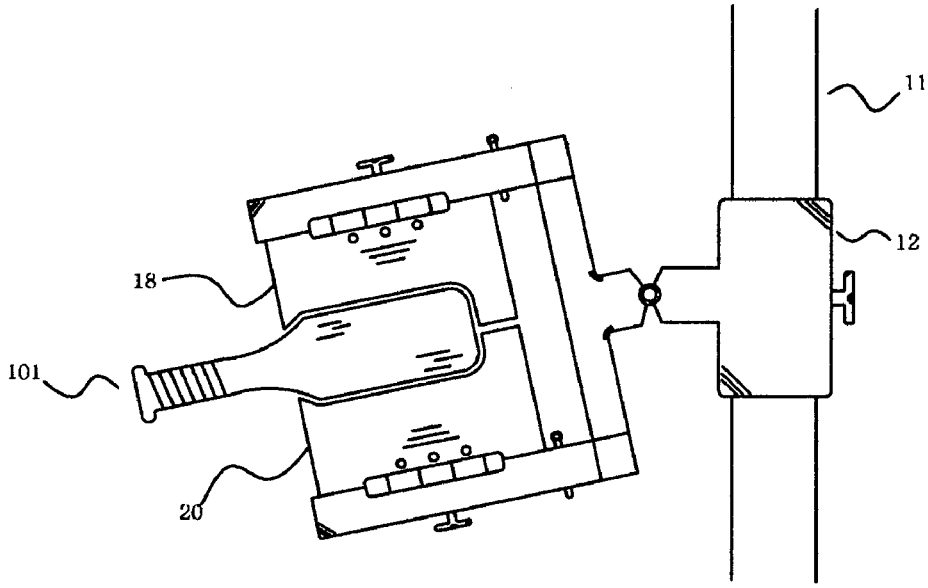
FIG. 3B illustrates a side view of the first embodiment of the assembly comprising flaps shaped to accommodate a baseball bat.

First zone guide 5 is comprised of at least a first arm 14 and can further comprise a first flap 18. Second zone guide 7 is comprised of at least a second arm 16 and can further comprise a second flap 20. Suitably, arms 14 and 16 can comprise any size, shape and length. Flaps 18 and 20 can also comprise any shape, length, width, and thickness that defines a training zone between the flaps. Each of arms 14 and 16 can be removed and replaced with arms of different size, shape and length. As shown in FIGS. 3A, 3B flaps 18 and 20 can be removed from the arms and replaced with flaps of alternate shapes, lengths, widths and thickness to change the size, shape and angle of entry/exit of the training zone.

In one implementation, first arm 14 and second arm 16 are attached at opposing ends of T member 15. First arm 14 and second arm 16 can be fixed to T member 15 and project out from T member 15 in a predetermined orientation including either in parallel or non-parallel arrangement. In another implementation, first arm 14 and second arm 16 can be attached to opposing ends of T member 15 by swivel joints 80, 81. Swivel joints allow each of arms 14 and 16 to be independently rotated about T member 15 and set in a desired position—as shown in FIG. 2, and discussed below. Suitable swivel joints include but are not necessarily limited to press fit, quick connect, tongue and groove, and cam and groove systems.

In yet another implementation, each of arms 14 and 16 can comprise hollow removable sleeves 50 and 51 that can be slid onto any arm and secured to the arms by arm pins 25 and 27. Suitably, arm pins 25 and 27 include but are not necessarily limited to ball bearing push pins and nut/bolt systems. The length of each of removable sleeves 50 and 51 is up to about the length of each base arm. It is an object of this implementation that each removable sleeve further comprise flaps 18 and 20 whereby sleeves 50 and 51 can be removed from the arm and replaced with alternate sleeves of varying lengths including flaps of varying lengths, shapes and sizes to change the size, shape and angle of entry/exit of the training zone.

As shown in FIG. 2, using a clock scheme from a top view, second arm 16 can be projected out at 12 o'clock relative to housing 12 and first arm 14 can be projected out from housing 12 at any non 12 o'clock position relative to housing 12. Likewise, first arm 14 can be projected out at 12 o'clock relative to housing 12. In the alternative, each of arms 14 and 16 can be projected out at 12 o'clock, or both arms can be set at any non 12 o'clock position. The operating range of motion for each of arms 14 and 16 relative to housing 12 can be from about 7 o'clock to about 5 o'clock. A particularly advantageous range of motion for each of arms 14 and 16 is from about 9 o'clock to about 3 o'clock relative to housing 12.

Each of arms 14 and 16 can be further configured to project out from T member 15 in a parallel orientation relative to the ground or floor, or in the alternative, arms 14 and 16 may extend out in a non-parallel orientation relative to the ground or floor. For example, the distance between arms 14 and 16 may be greater in proximity at the outermost edges of the arms than at the point of attachment of arms 14 and 16 to T member 15. Likewise, the distance between the outermost edges of arms 14 and 16 may be less in proximity than at the point of attachment to T member 15—as shown in FIG. 3A.

Figure 4:
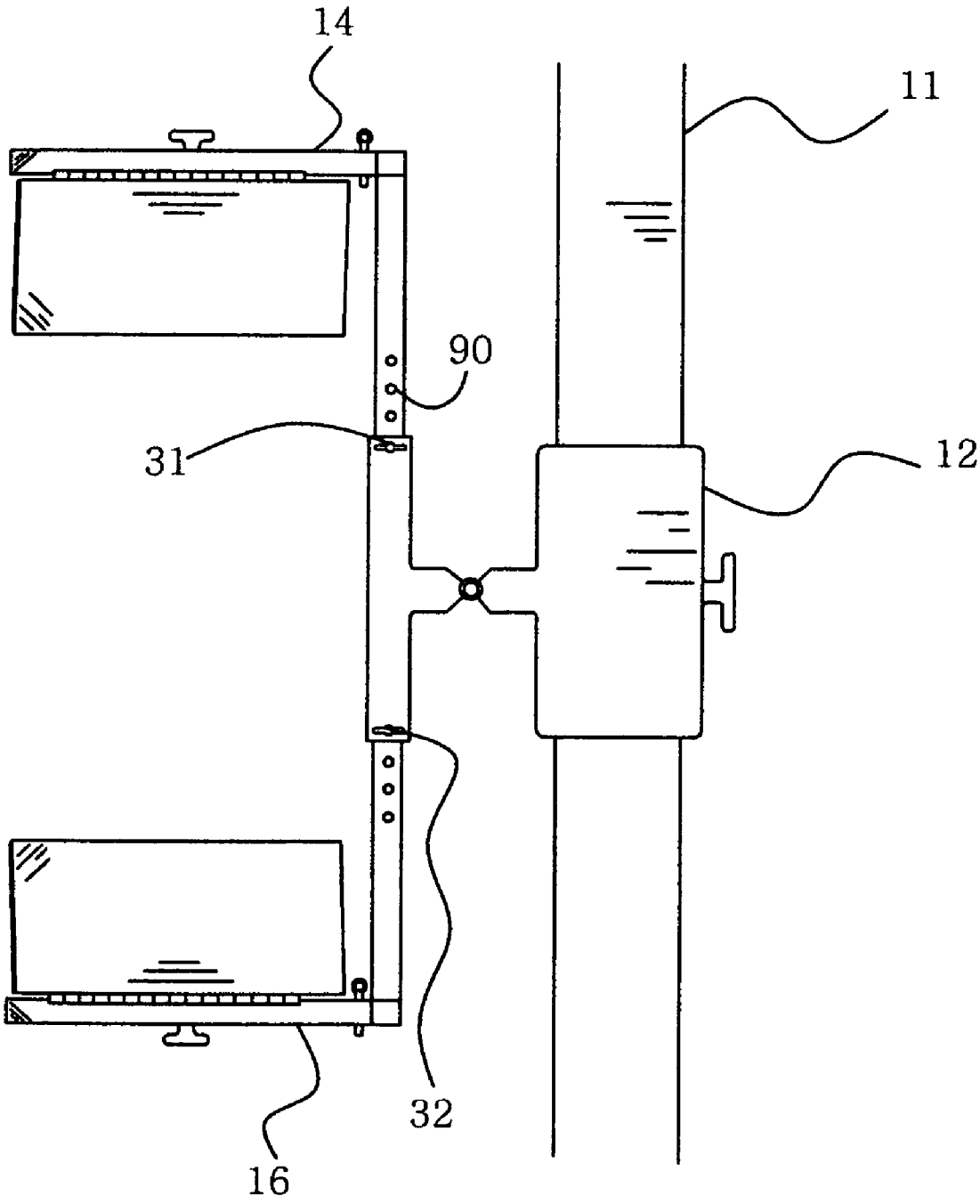
FIG. 4 illustrates a side view of at least a second embodiment of the assembly.

In a second non-limiting embodiment, as shown in FIG. 4, arms 14 and 16 comprise an "L-shape" wherein arms 14 and 16 are configured to fit and slide within T member 15 where each of arms 14 and 16 can be secured within T member 15 by pins 31 and 32. Pins 31 and 32 are configured to mate with openings 90 aligned on the surface of both arms 14 and 16 and T member 15. In addition, arms 14 and 16 can be slid into T member 15 or extended out along the length of T member 15 and set in position by pins 31, 32 to increase the distance between arms 14 and 16.

Looking at FIG. 3A that includes rectangular flaps, arms 14 and 16 can be configured to project out from housing 12 in a non-parallel arrangement wherein the outermost edges of both arms 14 and 16 and rectangular flaps 18 and 20 are closer in proximity than at the point of attachment of arms 14 and 16 to T member 15 and at the innermost edges of rectangular flaps 18 and 20. In the alternative, arms 14 and 16 can be configured to project out from housing 12 in non-parallel arrangement wherein both the arms 14 and 16 at the point of attachment to T member 15 and the innermost edges of rectangular flaps 18 and 20 are closer in proximity than at the outermost edges of both arms 14 and 16 and flaps 18 and 20.

Suitably, each of first flap 18 and second flap 20 are attached or otherwise fastened at at least one point along the length of first arm 14 and second arm 16 by at least a first hinge 17 and a second hinge 19. Hinges 17 and 19 are configured to produce tension to the fastened flaps 18 and 20 as outside force is applied to flaps 18 and 20. Upon application of force, flaps 18 and 20 can be rotated about hinges 17 and 19 from a starting position through a range of motion up to about 200° and then return to the starting position upon removal of the force from flaps 18 and 20. The rotating feature of flaps 18 and 20 is one of the wear resistant features previously mentioned. By rotating upon contact, the potential for material damage to either flap and the assembly as a whole is minimized. Suitable hinges include but are not necessarily limited to spring loaded tension hinges.

The hinges are configured to attach flaps 18 and 20 to arms 14 and 16 in any manner suitable to maintain each of the flaps and arms in a fastened condition during operation of assembly 10. Suitably, the manner in which hinges are joined to each of the arms and flaps includes but is not necessarily limited to welds, bolts and screws.

As shown in FIG. 1, each of arms 14 and 16 further comprise adjustment knobs 29 and 30. Adjustment knobs 29 and 30 are configured to position and set flaps 18 and 20 at any number of points through a range of motion up to about 200° about the hinges, thereby (a) allowing for rotation of flaps 18 and 20 from a fixed starting position through and up to the remaining range of motion, and (b) establishing various angles of entry/exit depending on the positioning of each of flaps 18 and 20. A suitable adjustment knob includes but is not necessarily limited to a wing nut tension bolt.

Figure 5A:
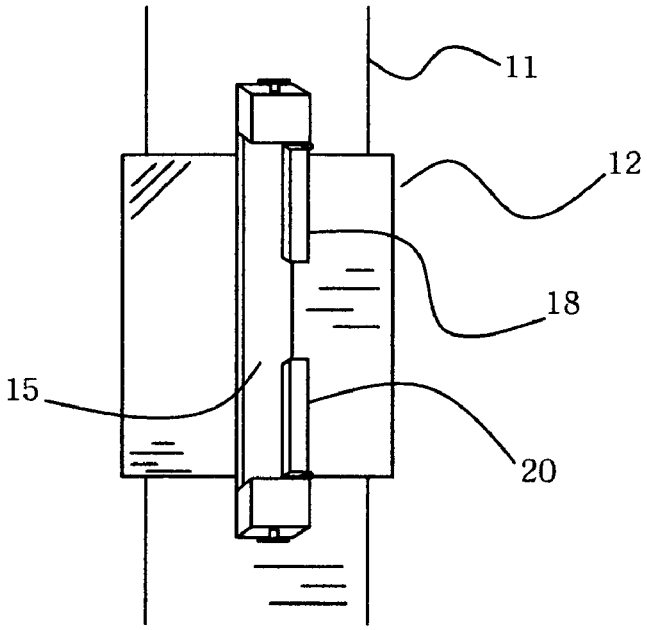
FIG. 5A illustrates a perspective view of the first embodiment of the assembly wherein the flaps of the assembly are in a vertical position.

In at least a first starting position, as shown in FIG. 5A, each of flaps 18 and 20 project out vertically from arms 14 and 16 on a single plane defining a training zone between flaps 18 and 20. In this first starting position, flaps 18 and 20 are closest in proximity than at any other point about each flaps' 200° range of motion.

Figure 5B:
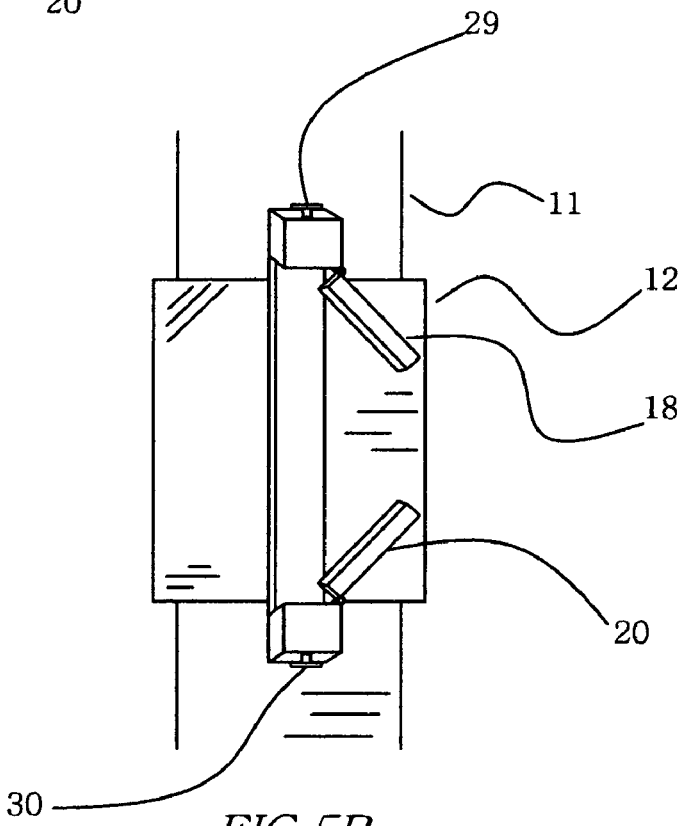
FIG. 5B illustrates perspective view of the first embodiment of the assembly wherein the flaps of the assembly are in a non-vertical position.

As shown in FIG. 5B, the size, shape and angle of entry/exit of the training zone can be varied or altered from the first starting position of FIG. 5A. In this second position, first flap 18 and second flap 20 project out from arms 14 and 16 at a point along the 200° range of motion and are fixed in position by adjustment knobs 29 and 30.

Figure 6:
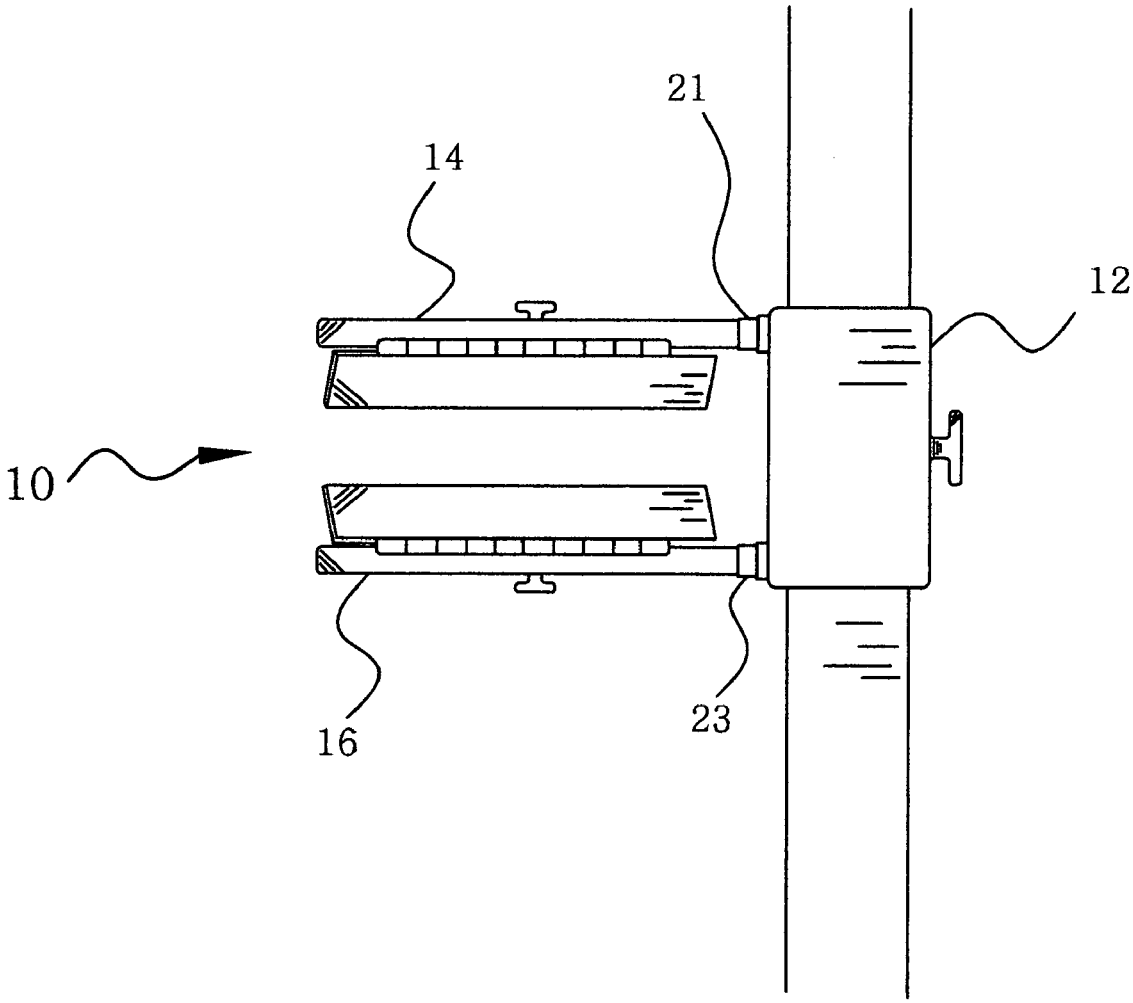
FIG. 6 illustrates a side view of at least a third embodiment of the assembly.
Figure 7A:
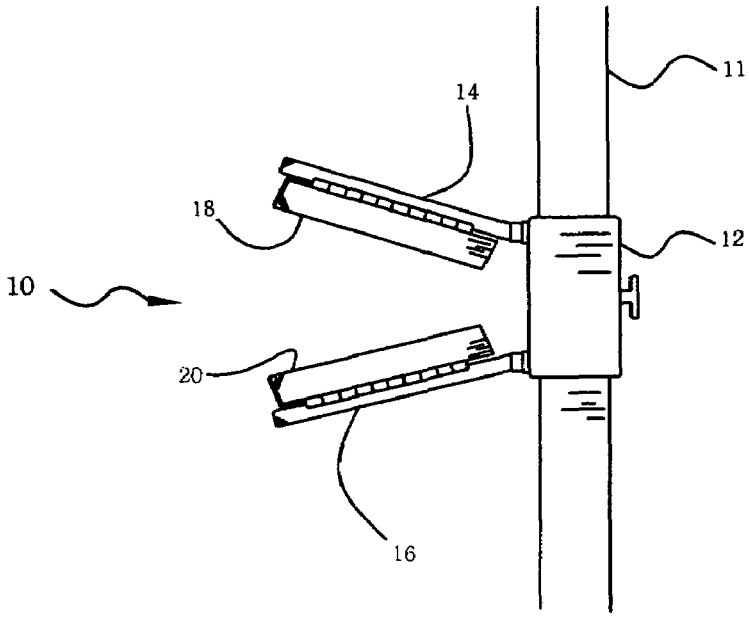
FIG. 7A illustrates a side view of the third embodiment wherein the arms are extended away from one another.

In a third non-limiting embodiment as shown in FIG. 6, assembly 10 comprises arms 14 and 16 that are independently attached to housing 12 via socket joints 21 and 23. Socket joints 21 and 23 are configured to maneuver arms 14 and 16 about joints 21 and 23 to position or fix arms 14 and 16 in various orientations about socket joints 21 and 23. As shown in FIG. 7A, arm 14 can be positioned at an upward angle relative to housing 12 and arm 16 can be positioned at a downward angle relative to housing 12. In this position, the arms 14 and 16 at the attachment to socket joints 21 and 23 are closer in proximity than at the outermost edges of the arms.

Figure 7B:
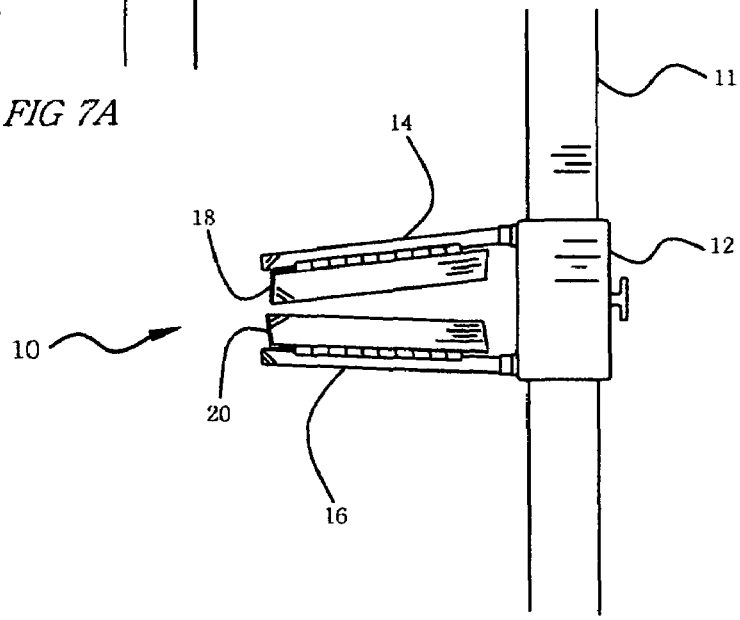
FIG. 7B illustrates a side view of the third embodiment wherein the arms are extended towards one another.

In the alternative, as shown in FIG. 7B, arm 14 can be positioned at a downward angle relative to housing 12 and arm 16 can be positioned at an upward angle relative to housing 12. In this position, the outermost edges of arms 14 and 16 are closer in proximity than at the attachment to socket joints 21 and 23. Also, as discussed above in relation to FIG. 2, each of arms 14 and 16 can be oriented relative to housing 12 from about 9 o'clock to about 3 o'clock. As shown in FIGS. 2, 7A, and 7B, each of the arms 14 and 16 can project out from housing 12 in any non-parallel orientation.

In addition, the use of housing 12 can be eliminated altogether wherein arms 14 and 16 and socket joints 21, 23 are each independently attached to a surface including but not necessarily limited round and flat surfaces. For instance, each arm/socket joint combination can be attached to a wall to define a desired training zone between the arms. Each of the arms can project out from the surface in any non-parallel orientation.

Figure 8:
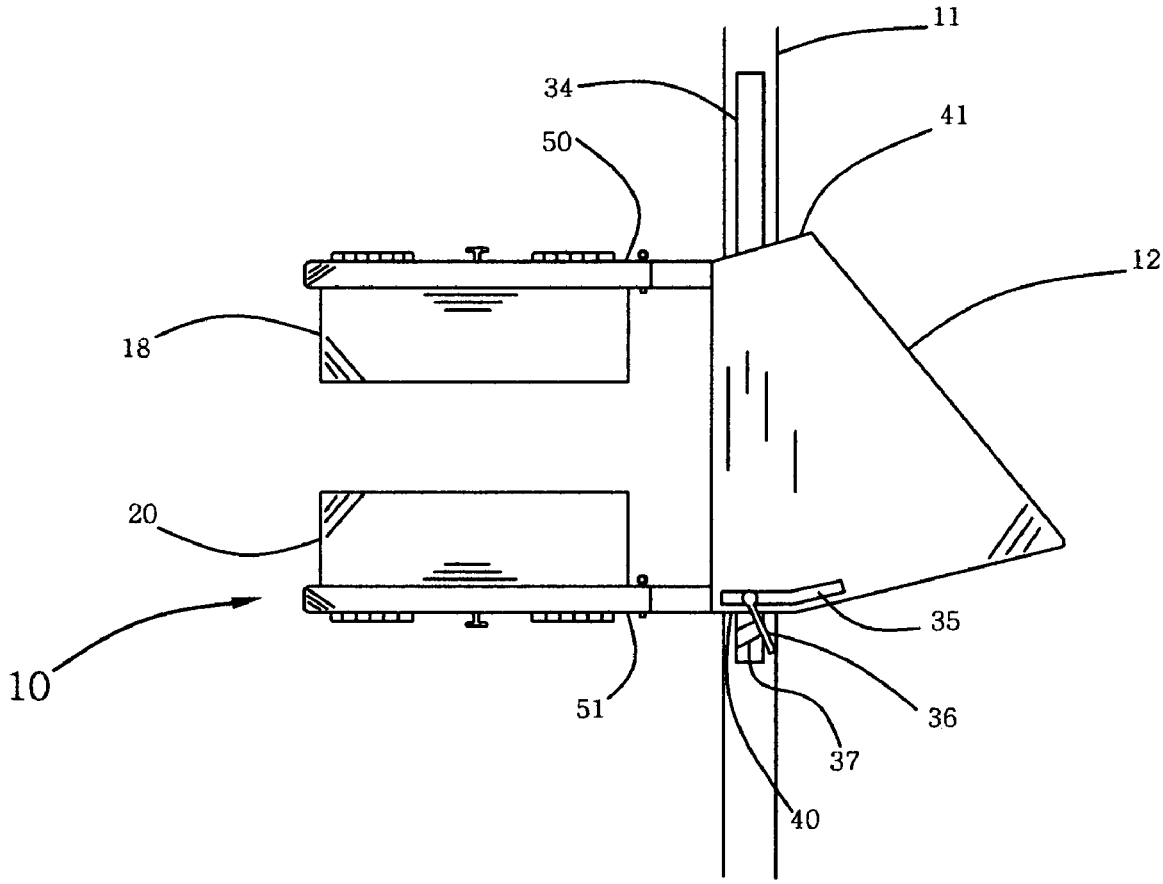
FIG. 8 illustrates a side view of at least a fourth embodiment of the assembly.

In a fourth non-limiting embodiment, as shown in FIG. 8, assembly 10 comprises a housing 12 defined by an opening there through that is configured to telescope or slide along the length of support 11. Suitably, an extension member 13 including a T member 15, and a pivot joint 22 can be included with the assembly 10, or in the alternative, the arms can be attached to housing 12 as shown in FIG. 8.

Suitably, housing 12 envelopes support 11 and telescopes along the length of a support 11 as guided by a support slit 34 that runs a predetermined distance along the length of support 11. Slit 34 comprises openings on opposing sides or edges of support 11, the openings running equidistant along support 11. Slit 34 also comprises at least a first resilient member, herein referred to as support spring 37 that is set inside slit 34 underneath housing 12, and configured to act as a force upon housing 12 to assist repositioning housing 12 along support 11 either up or down. For example, where support 11 is vertical relative to the ground or floor, the support spring 37 applies an upward force to housing 12 along slit 34 thereby easing the work required of an individual to reposition the housing upward along support 11. Similarly, the force supplied by support spring 37 is not too great to prohibit an individual from easily moving or repositioning housing 12 downward along support 11.

Suitably, housing 12 comprises an inner construction configured to fasten to a round or multi-sided support 11. Housing 12 further comprises an adjustment slot 35 and an adjustment handle 36. Slot 35 is configured to run parallel to the bottom side 40 of housing 12. Handle 36 is configured to tighten housing 12 to support 11. Suitably, handle 36 fits inside slot 35 and extends through slit 34 where opposing ends of handle 36 extend beyond either side of both support 11 and housing 12.

A suitable handle 36 comprises an adjustment member to (1) tighten housing 12 in a desired position vertically along support 11 and (2) loosen housing 12 from support 11. Suitable handles 36 include but are not necessarily limited to a crank and bolt system. As shown in FIG. 8, handle 36 comprises a crank and bolt system that extends through slit 34 to either side of housing 12 and tightens housing 12 to support 11.

Bottom side 40 of housing 12 further comprises an opening that runs about the length and width of bottom side 40 and is configured to allow the bottom side 40 of housing 12 to pivot, shift or tilt about support 11. In like manner, top side 41 comprises a width greater than the width or diameter of support 11 to provide clearance for housing 12 about support 11 as bottom side 40 is pivoted, shifted or tilted about support 11.

As bottom side 40 of housing 12 is shifted about support 11, slot 35 of housing 12 also shifts about handle 36 so that slot 35 is repositioned from a first point about handle 36 to a second point about handle 36 wherein handle 36 can then retighten housing 12 to support 11.

Figure 9:
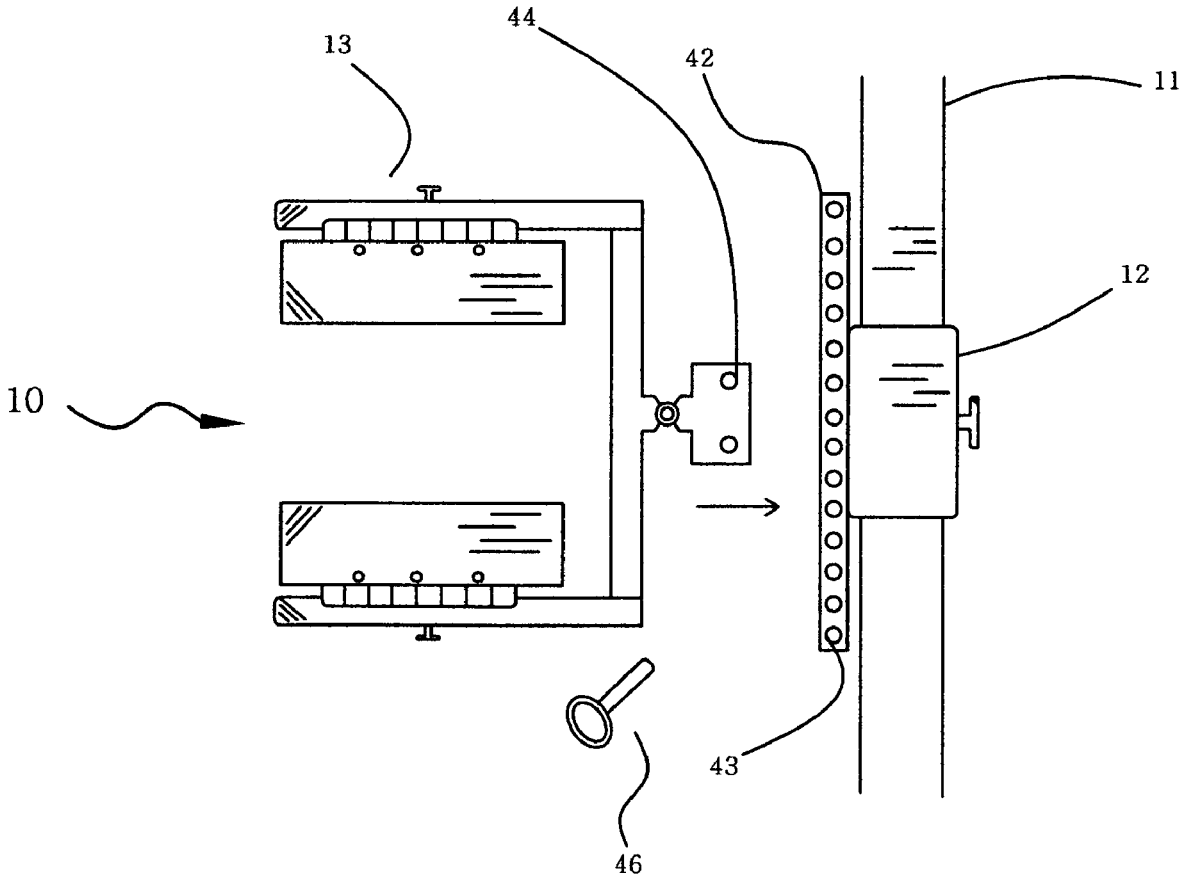
FIG. 9 illustrates a side view of at least a fifth embodiment of the assembly.

In a fifth non-limiting embodiment, as shown in FIG. 9, the assembly 10 comprises an adjustable connection herein referred to as an adjustment spine 42 attached to housing 12. Adjustment spine 42 is configured so that extension member 13 can be adjusted along adjustment spine 42 while housing 12 remains fixed at a point along support 11.

Spine 42 and extension member 13 comprise apertures 43 and 44 there through configured so that apertures 43 along spine 42 can be aligned with apertures 44 along extension member 13. Once the apertures are aligned, spine pin 46 can be placed through both sets of apertures 43, 44 to join extension member 13 to spine 42.

Suitably, spine 42 comprises at least one aperture 43. In a particularly advantageous embodiment, spine 42 comprises at least two apertures 43 for varying the position of extension member 13 along spine 42. Likewise, extension member 13 comprises at least one aperture 44 for attachment to spine 42.

Apertures 43, 44 can comprise any shape for aperture alignment and further mating with spine pin 46. Likewise, pin 46 is configured to mate with apertures 43, 44. Adjustment of extension member 13 along spine 42 involves removing spine pin 46 from apertures 43, 44 and relocating extension 13 from a first position along spine 42 to a second position along spine 42 wherein the aperture(s) 44 of extension member 13 is/are aligned with aperture(s) 43 at a second position along spine 42.

In the alternative, extension member 13 can comprise protrusions or teeth that replace apertures 44 wherein the protrusions or teeth are configured to extend out laterally from extension member 13 to mate with apertures 43—alleviating the necessity of using a spine pin 46 for joining extension member 13 to housing 12. In addition, spine 42 can be attached to extension member 13 instead of housing 12 whereby the apertures along spine 42 align with stationary apertures located on housing 12.

Figure 10:
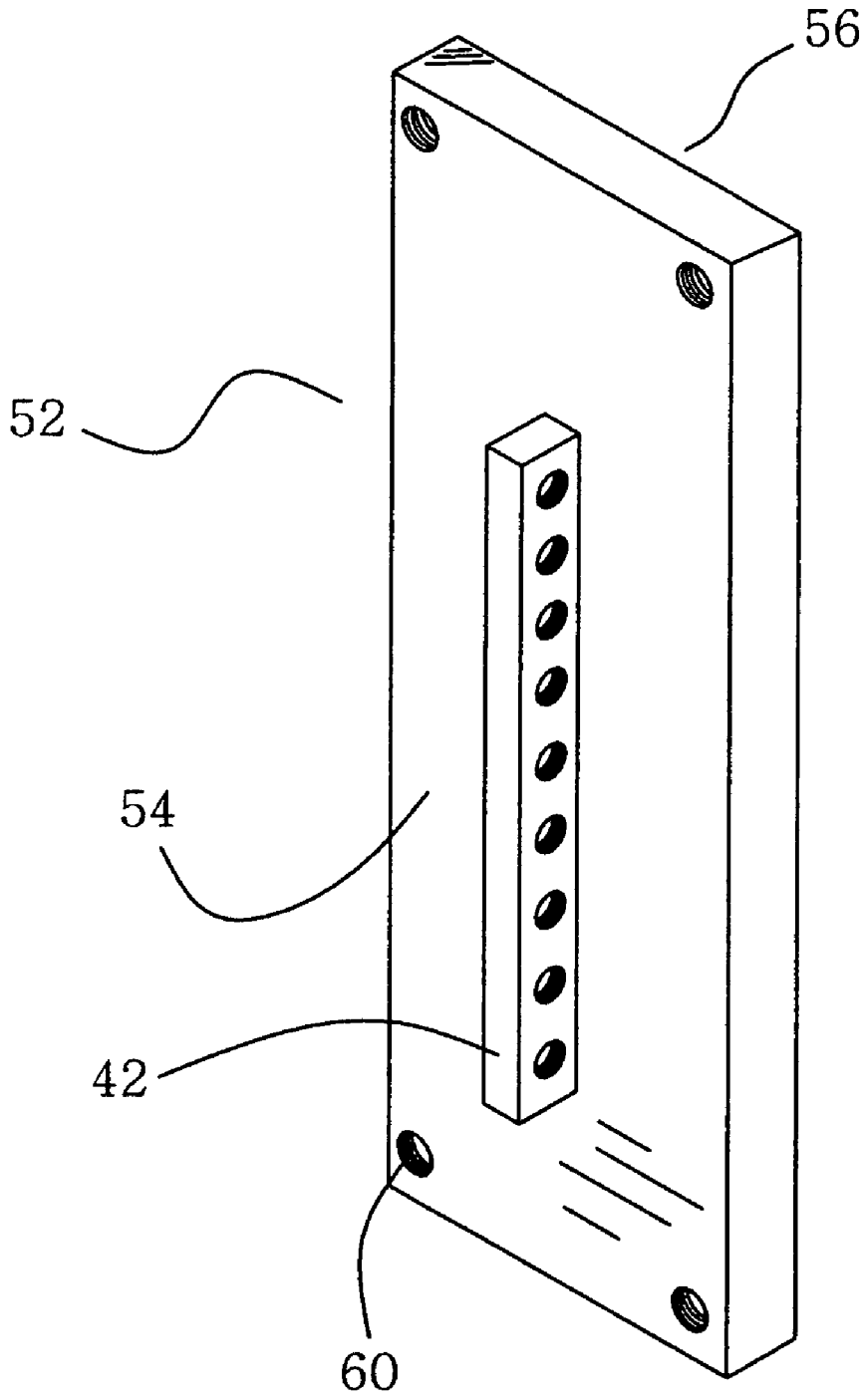
FIG. 10 illustrates a perspective view of a plate for fastening to the support.
Figure 1:
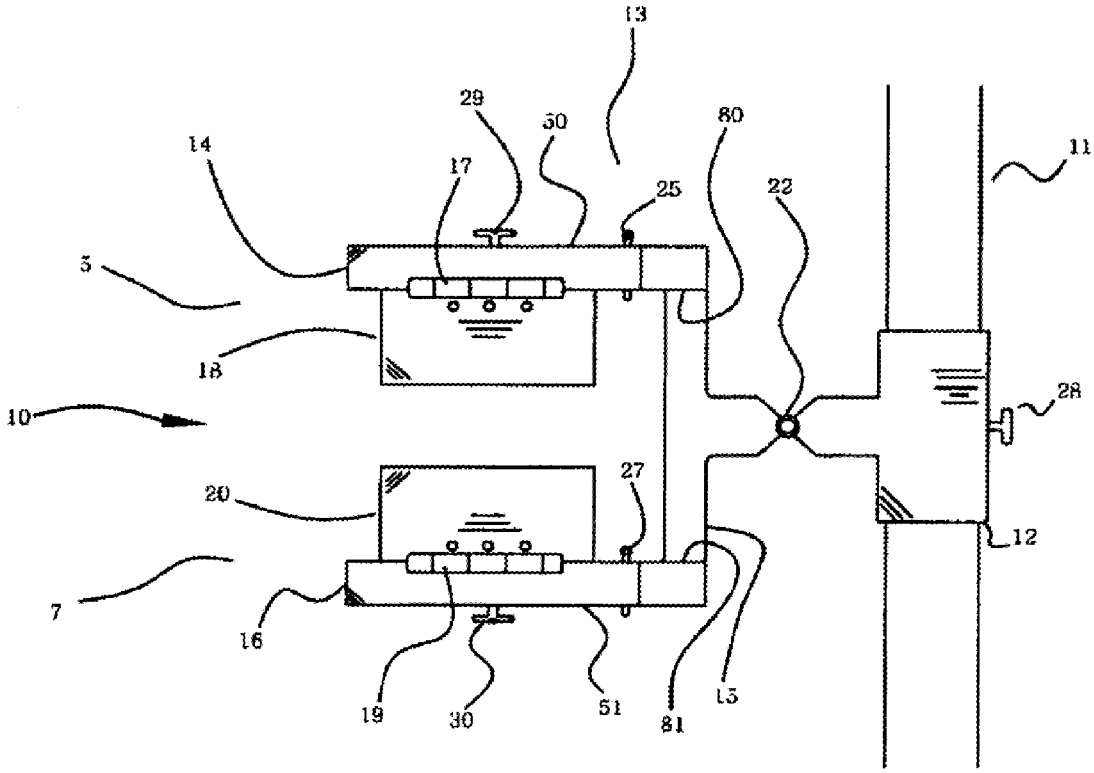
Figure 2:
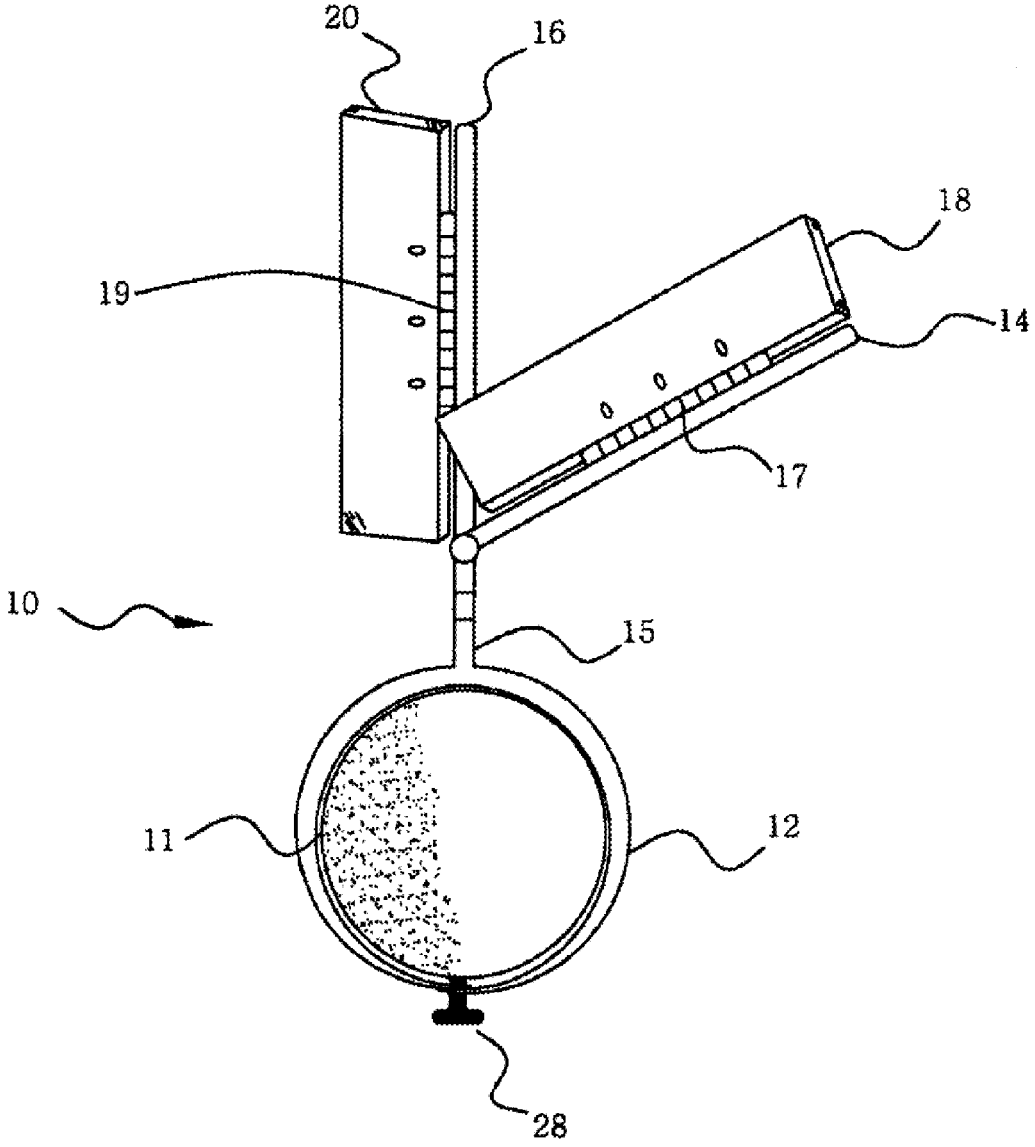
Figure 3A:
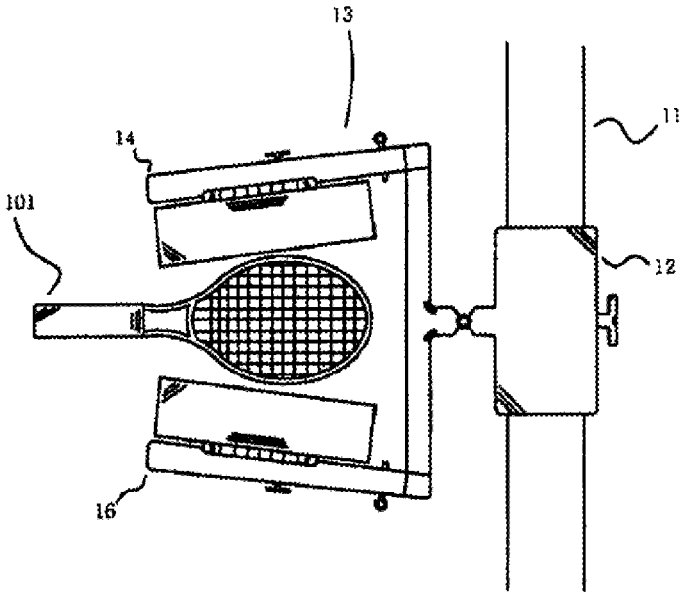
Figure 3B:
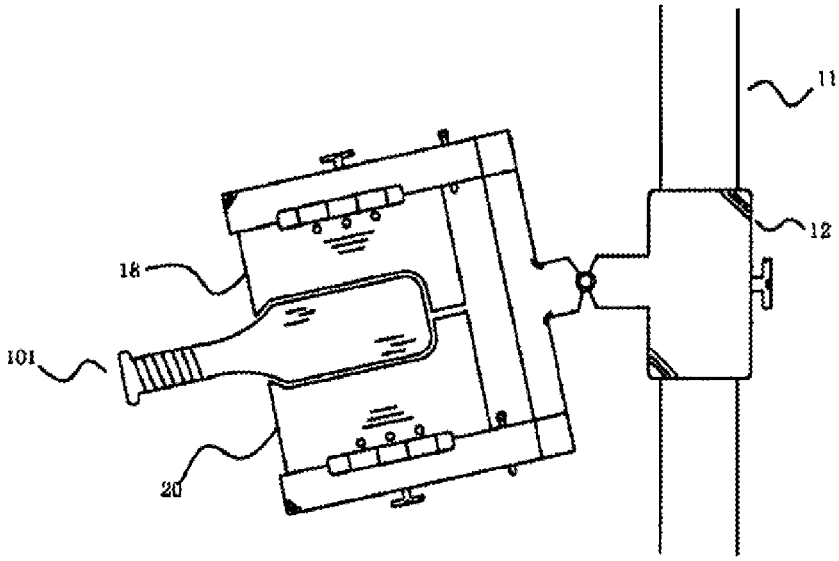
Figure 4:
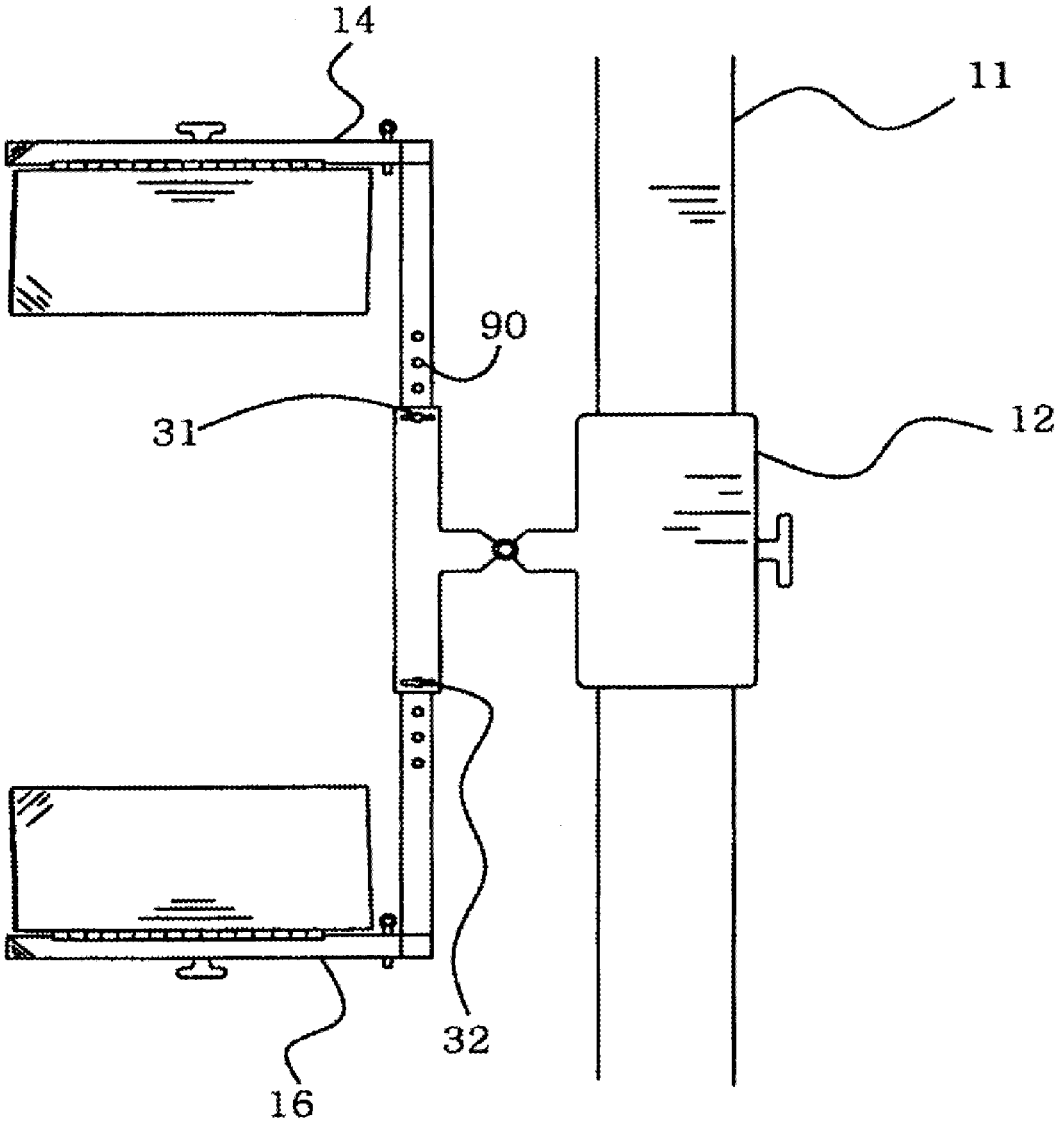
Figure 5A:
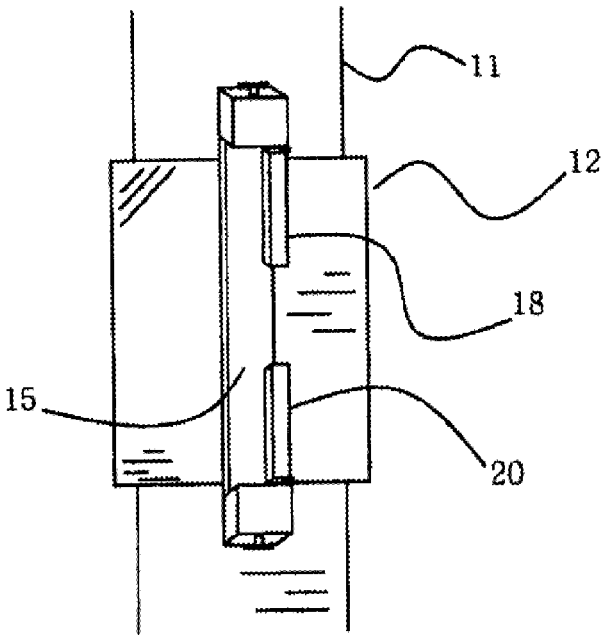
Figure 5B:
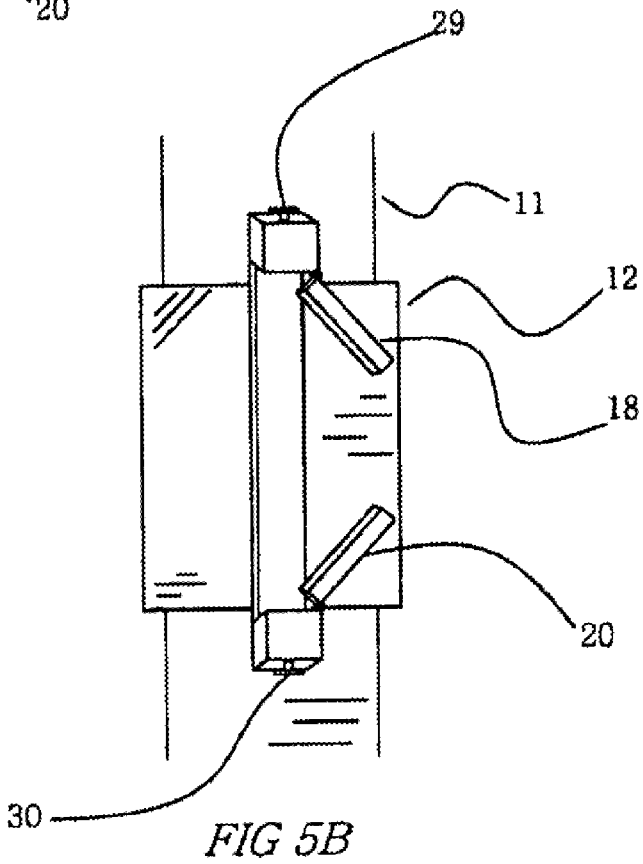
Figure 6:
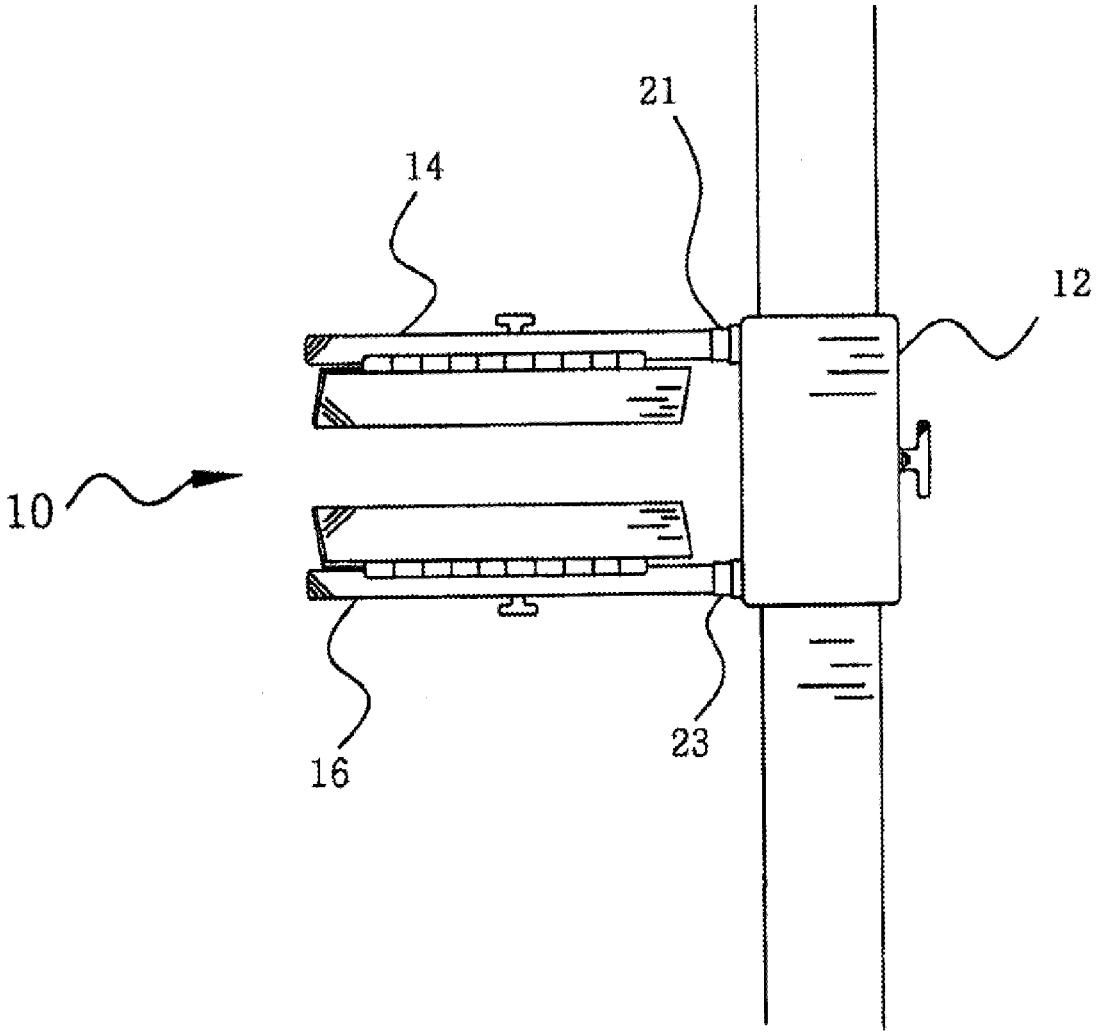
Figure 7A:
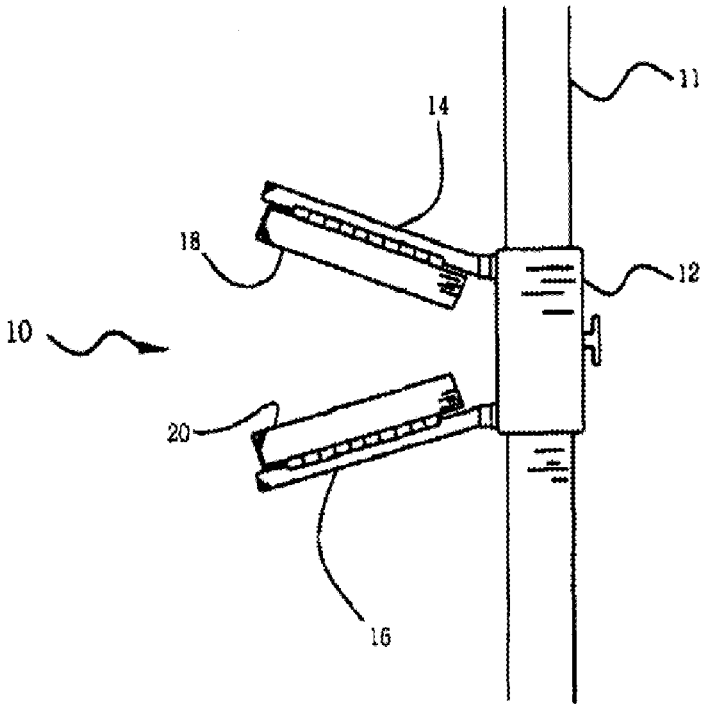
Figure 7B:
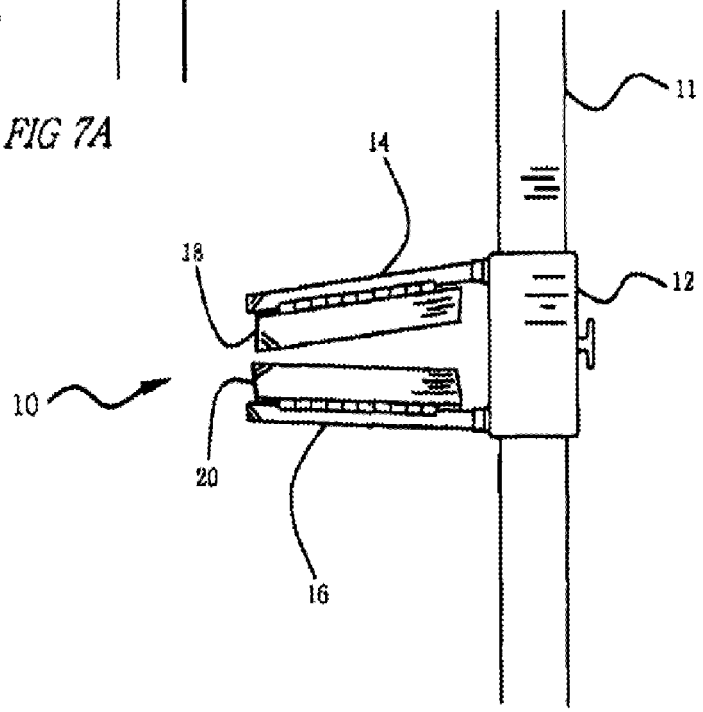
Figure 8:
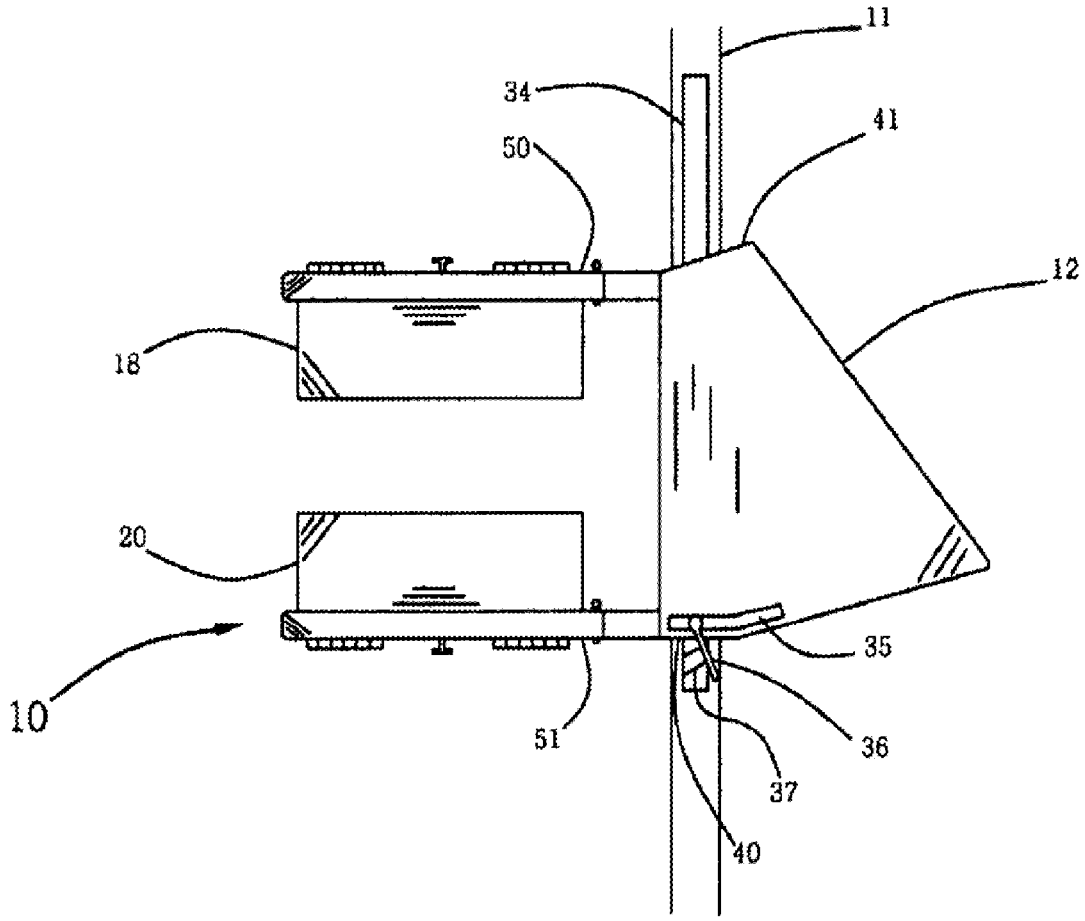
Figure 9:
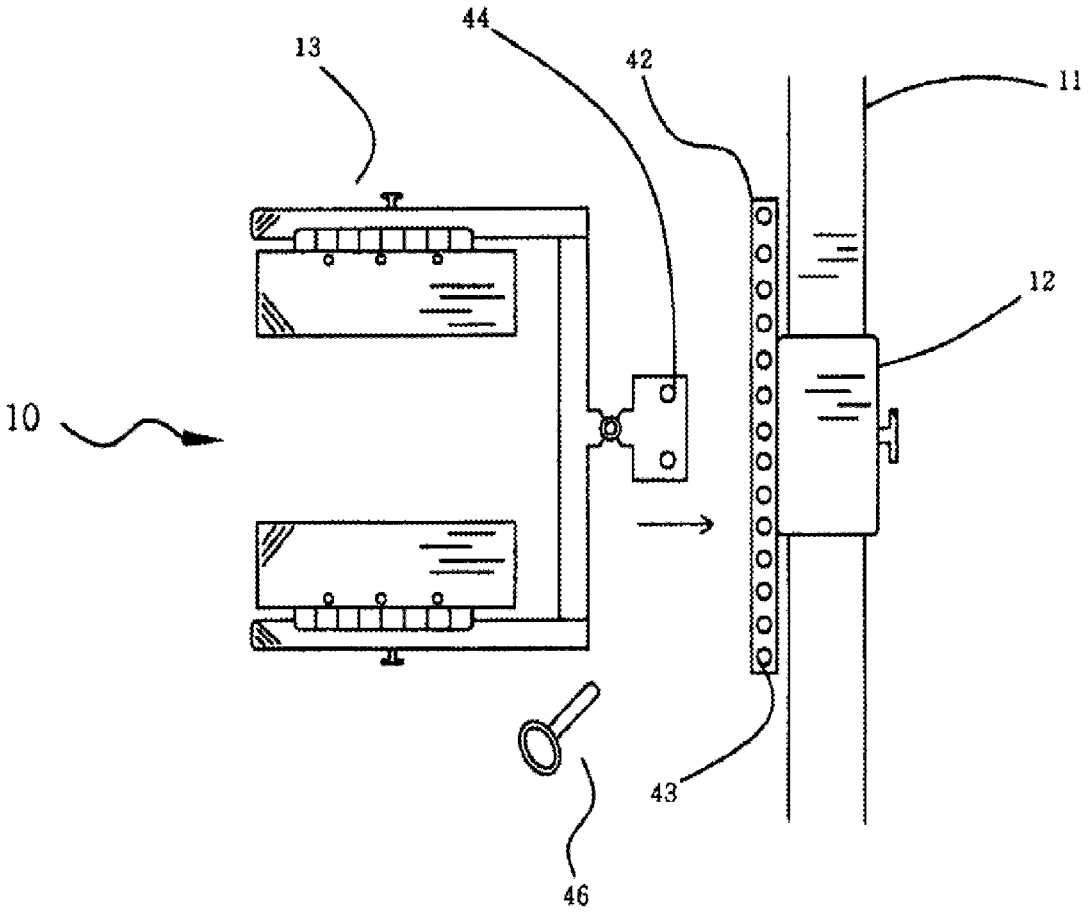
Figure 10:
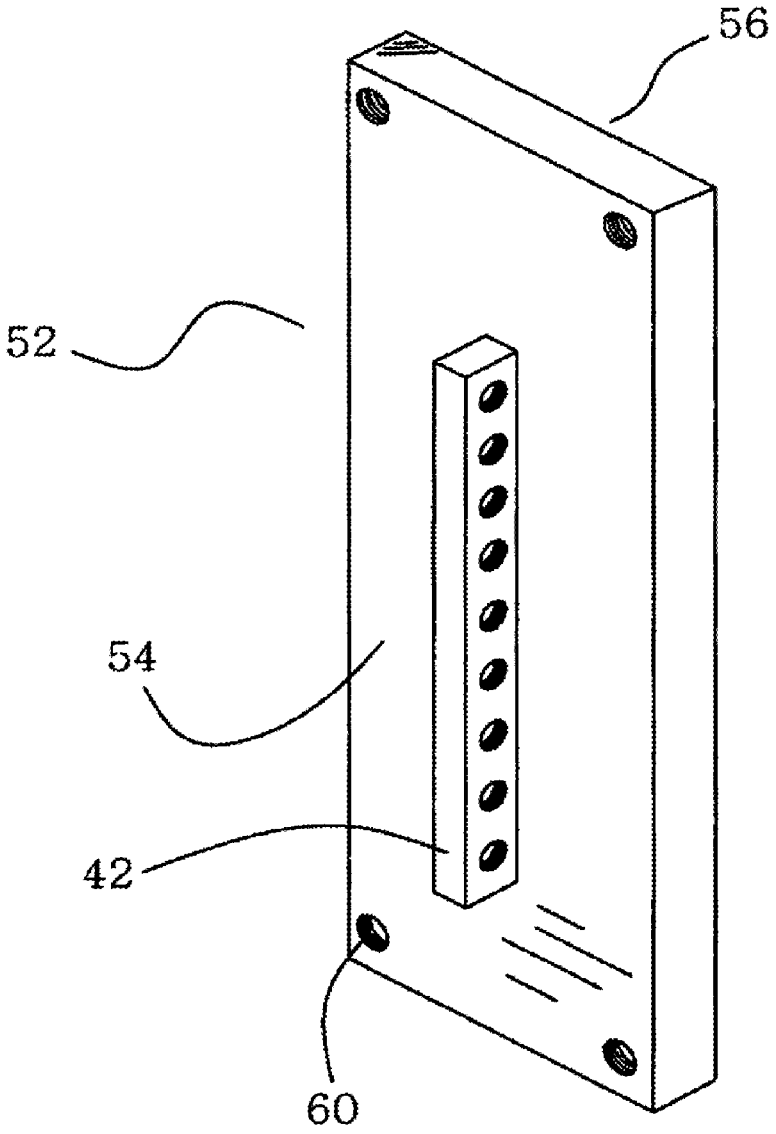

In a sixth non-limiting embodiment, as shown in FIG. 10, a fastening member herein referred to as a plate 52 is used to fasten or otherwise connect the assembly 10 to support 11. Plate 52 comprises at least a first outer surface 54 for attachment to extension member 13, and at least a second inner surface 56 for fastening or otherwise connecting to support 11. Inner surface 56 comprises a substantially flat surface and is configured to be fastened or otherwise connected to a support 11 comprising a substantially flat side or surface. The substantially flat side of surface 56 allows surface 56 to be connected to various supports including but not necessarily limited to floors, walls, ceilings, fences, posts and tree trunks.

Suitably, plate 52 can comprise any outer shape including but not necessarily limited to circular and multi-sided shapes. Plate 52 can also comprise any thickness but suitably should not comprise a thickness any greater than the width of plate 52.

In addition, plate 52 comprises holes 60 there through configured to mate with screws or nails for fastening fasten plate 52 to support 11. In the alternative, second surface 56 can comprise spikes extending out from surface 56 that can be driven into support 11 thereby fastening plate 52 to support 11.

First surface 54 can comprise an adjustment spine 42 for attaching extension member 13 to plate 52—as shown in FIG. 10. First surface 54 can also comprise pivot joints, swivel joints, socket joints, and rotable fittings discussed below for attaching extension member 13 to plate 52.

In a seventh non-limiting embodiment, as shown in FIG. 11A, the assembly 10 comprises an extension member 13, a support 11 including an adjustment spine 42 attached along the length of support 11, and an adjustable connection herein referred to as a junction member 62 for connecting extension member 13 to support 11 via adjustment spine 42. In addition, adjustment spine 42 is configured along support 11 so that extension member 13 can be adjusted along spine 42.

Junction member 62 is configured to attach to spine 42 by aligning apertures on both junction member 62 and spine 42 for mating with spine pin 46. Junction member 62 comprises at least one aperture 44 for attachment to apertures 43 of spine 42.

Junction member 62 further comprises a rotable female opening 70 configured to mate with male member 71 of extension member 13 wherein male member 71 rests within female opening 70 of junction 62. In one implementation, junction member 62 comprises a round opening 70 for mating with male member 71. Suitably, male member 71 is slidable within opening 70 wherein extension member 13 is rotable 360° about junction member 62.

Junction member 62 and male member 71 further comprise junction holes 66. Upon alignment of holes 66 of both junction member 62 and male member 71, at least one junction pin 46 can be placed through holes 66 fixing extension member 13 to junction member 62. In addition, extension member 13 can be rotated and set at a desired position within junction member 62 prior to placing junction pin 64 through holes 66 of both male member 71 and junction member 62. Junction member 62 and/or male member 71 can further comprise any number of holes 66 aligned along its circumference allowing for multiple positions of extension member 13.

It should be noted that the embodiments as shown in FIG. 9 and FIG. 11A do not require removable sleeves 50, 51, nor do they require reattachment of flaps 18, 20 to switch the direction of the flaps during use of the assembly 10. The direction of the flaps can be switched by rotating extension member 13 about 180° and reattaching extension member 13 to adjustment spine 42.

A top view of adjustment spine 42 is displayed in FIG. 11B. In a particularly advantageous embodiment, spine 42 comprises a lip running along its length. Junction member 62 comprises a slot configured to mate with lipped spine 42. Suitably, junction member 62 mates with spine 42 and tracks along the length of spine 42.

Figure 12:
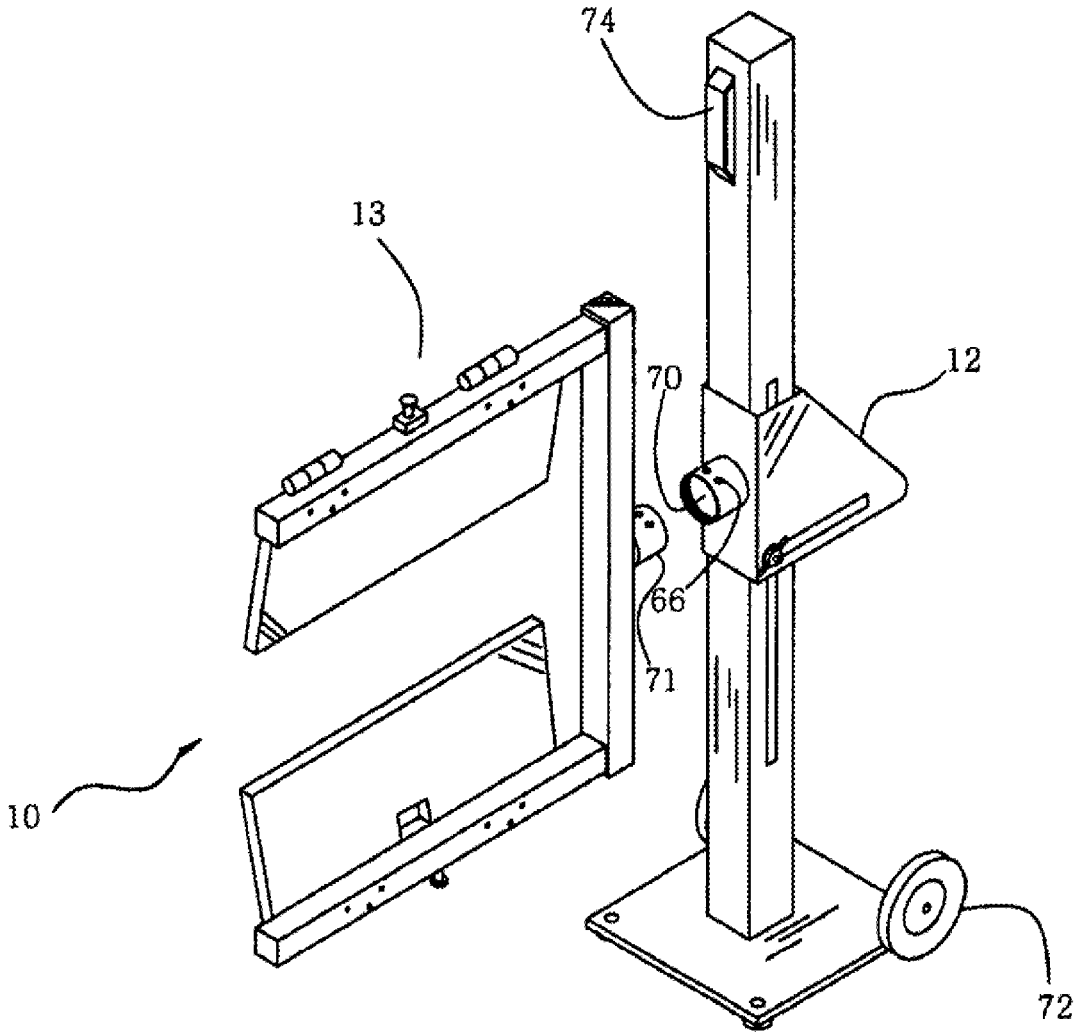
FIG. 12 illustrates a perspective view of at least an eighth embodiment of the assembly.

In an eighth non-limiting embodiment, as shown in FIG. 12, the assembly 10 comprises an extension member 13 configured to rest within housing 12. Housing 12, configured similarly to the housing shown in FIG. 8, comprises a female round opening 70 to receive male member 71 of extension member 13. Suitably, round opening 70 projects out from housing 12 at a distance creating a suitable depth for male member 71 to slide into opening 70.

Round opening 70 can project out from housing 12 at any suitable distance to create a mating depth for male member 71. A suitable depth includes but is not necessarily limited to from about 2 inches to about 3 inches. In a particularly advantageous embodiment, the depth of opening 70 is about 2½ inches. Likewise, any male member 71 can comprise a length greater than or equal to the depth of opening 70. In a particularly advantageous embodiment, the length of male member 71 allows for alignment of holes 66 of both the male member 71 and opening 70. Thus, the length of male member 71 can be less than the depth of opening 70 as long as holes 66 can be properly aligned. It should be noted that in the embodiments as shown in FIGS. 11A and 12, the assembly 10 can alternatively comprise an extension member 13 comprising the female opening and a junction member 62 or housing 12 comprising the male member 71.

Suitably, each of opening 70 and male member 71 comprise at least one hole 66 that can be aligned and fixed using a junction pin 46. In one implementation, each of opening 70 and male member 71 comprise a series of holes 66 for fixing extension member 13 at any number of points. The holes can be positioned around the opening 70 and male member 71 to rotate and set the extension member 13 any number of degrees between fixed positions. In one embodiment, holes 66 are positioned to rotate and set extension member 13 about 10° between fixed positions. In another embodiment, holes 66 are positioned to rotate and set extension member 13 about 20° between fixed positions. In still another embodiment, holes 66 are positioned to rotate and set extension member 13 about 50° between fixed positions.

The assembly 10 can further comprise wheels 72 and a handle 74 for transporting or handling of assembly 10. The assembly of FIG. 12, can also comprise any of the features previously discussed including but not necessarily limited to a swivel joint, and pivot joint.

Assembly 10 is comprised of any material durable enough to be held in position at a predetermined height while absorbing impacts of varying forces at varying speeds from a plurality of training members that are constructed of materials comprising densities both greater and less than those of assembly 10. Suitable assembly materials include but are not necessarily limited to metals, plastics, woods, fiberglass, plexiglass, and filled composite materials. In particular, the arms and/or flaps are constructed of materials including but not necessarily limited to those materials resistant to chipping, cracking, excessive bending and reshaping of the arms and/or flaps as a result of ozone, weathering, heat, moisture, other outside mechanical and chemical influences, as well as the above mentioned impacts. Likewise, the arms and flaps can comprise any color or combination of colors. The arms and flaps can also be transparent and translucent depending on individual preferences and needs.

Operation of the Assembly

Ordinarily, people use handheld tools, athletic implements, or other utensils ("training member 101") to contact against a particular object (e.g., contacting a baseball bat to a baseball, hitting the head of a nail with a hammer, contacting a martial arts weapon to an apple atop a person's head). As opposed to contacting an object with a training member 101, the assembly 10 is used to train the hand/eye coordination of an individual by avoiding contact between the assembly and training member 101 as the training member 101 is maneuvered through a training zone defined by the assembly 10.

In particular, the hand/eye coordination of an individual is trained or otherwise developed by maneuvering the training member 101 through the training zone in an attempt not to contact any part of the arms and/or flaps of the assembly 10 as the training member 101 is maneuvered through the training zone. For example, any contact between the flaps and the tennis racket of FIG. 3A, indicates to an individual not only of failure in successfully avoiding contacting the assembly 10, but also there is an indication of where along the surface of the tennis racket the contact with the assembly 10 occurred. This feedback allows a user to make any necessary adjustments in their swing to successfully maneuver the racket through the training zone of the assembly. The improved ability to successfully maneuver a training member 101 through a training zone correlates to improved ability to contact that same training member 101 against a target object—in this instance, a tennis racket to a tennis ball.

In practice, (a) a predetermined width and length of a training member is maneuvered through (b) a predetermined width and length of a training zone (collectively referred to as the "overlapping region"). For example, where the training member 101 is a baseball bat, the assembly 10 is set at a height and uses arms and/or flaps correlating to a desired width and length of training zone to match an individual's strike zone including proper plate coverage—this typically includes an overlapping region and angle of entry/exit (i.e., swing path) for at least the barrel of a baseball bat.

Of particular importance is the ability to use the assembly 10 to develop an individual's hand/eye coordination along a particular length of the training member (e.g., barrel of the bat) on both the top side and the bottom side of the training member simultaneously. An example would include the swinging of a bat through the training zone below first flap 18 and above second flap 20. As the overlapping region increases in length, the surface area of the training member being maneuvered through the training zone increases, demanding increased hand/eye coordination to properly maneuver the training member through the training zone.

An additional feature of assembly 10 is that various training zones can be defined by modifying or changing the training zone on planes X, Y, and Z relative to the support by varying (1) the length, thickness and shape of arms 14 and 16, (2) the length, thickness and shape of flaps 18 and 20, (3) the orientation of the arms relative to one another as projected out from housing 12 or support 11, and (4) the orientation of flaps 18 and 20 about either arm 14 or 16. Hence, by manipulating the arms and/or flaps of assembly 10, various training zones can be defined between the arms and/or flaps to accommodate variable size and shape training members. Also, various angles of entry/exit of a training member can be accommodated up to 360° relative to housing 12.

Depending on the particular embodiment of assembly 10, an individual fastens assembly 10 at a desired point on support 11. Arms 14 and 16 are set in position relative to one another. In addition, flaps 18 and 20 can be set in position about arms 14 and 16 at a point along each flaps' 200° range of motion. Once the arms and flaps are set in position, a particular training zone on planes X, Y and Z relative to the support is defined between the arms and flaps.

Training indicators can also be added at various points along at least one of the arms and/or flaps of assembly 10. The training indicators provide feedback to an individual showing the exact point(s) along the arms and/or flaps at which either the top surface, bottom surface, or edge of the training member contacted the arms and/or flaps. Suitable training indicators include but are not necessarily limited to impact tape or stickers, clay, paint, and carbon paper. In a particularly advantageous embodiment, impact tape or sticker material is placed along the length of the arms 14, 16 and/or flaps 18, 20. As a training member 101 being maneuvered through the training zone contacts either an arm or flap or both, a mark is left on the impact tape indicating the exact point on the arm or flap where the training member 101 contacted the arm or flap or both. An individual can use this feedback to make adjustments for future attempts at maneuvering the training member 101 through the training zone of assembly 10. Impact tape or stickers can be purchased from the following commercial suppliers: Golfsmith, Austin, Tex.

Additional wear resistant features can be included and placed on the arms and/or flaps of the assembly 10 to minimize the effects of contact between the assembly and the training member 101. Suitable wear resistant features include but are not necessarily limited to foam, rubber, cloth, and sponge.

The embodiments described above will be better understood with reference to the following non-limiting examples, which are illustrative only and not intended to limit the present application to a particular embodiment.

EXAMPLE 1

In a first non-limiting example of the assembly disclosed herein, an assembly is used to train the hand/eye coordination of an individual swinging various training members through a training zone of the assembly.

An assembly, as shown in FIG. 11A, is provided including the following dimensions:

| | | |
|---|---|---|
| Support and Adjustment Spine | | |
| Height of Support including the adjustment spine = | | 7 feet |
| Diameter of apertures on adjustment spine = | | ¾ inch |
| Extension Member | | |
| First Zone Guide | First arm length = | 15 inches |
| | Width of each side of first arm = | 1½ inches |
| | First Flap length = | 13 inches |
| | First Flap height = | 5 inches |
| | First Flap width = | ½ inch |
| Second Zone Guide | Second arm length = | 15 inches |
| | Width of each side of second arm = | 1½ inches |
| | Second Flap length = | 13 inches |
| | Second Flap height = | 5 inches |
| | Second Flap width = | ½ inch |
| T Member length = | | 13 inches |
| Outer Diameter of Male Member = | | 2⅞ inches |
| Junction Member | | |
| Diameter of apertures = on Junction Member | | ¾ inch |
| Junction Member length = | | 7 inches |
| Inner Diameter of opening = | | 2½ inches |
| Outer Diameter of opening = | | 2¾ inches |
| Depth of opening = | | 2½ inches |
| Diameter of holes of Male Member and Junction Member = | | 7/16 inches |

In operation, the junction member 62 is positioned at a desired point along the adjustment spine 42. The male member 71 of extension member 13 is mated with opening 70 of the junction member 62 and is fixed about the pivot joint at a desired angle. Once the height and angle of the swing path are determined, the first and second rectangular flaps are set about the arms at a desired point along each flaps' 200° range of motion to establish the angle of entry/exit. The distance between the bottom side of the horizontal first flap and the top side of horizontal second flap comprises enough spacing for maneuvering a desired training member 101 between the flaps without contacting the flaps.

EXAMPLE 2

In a second non-limiting example, an assembly is used to train the hand/eye coordination of an individual swinging a baseball bat through the training zone.

An assembly, as shown in FIG. 12, is configured to fasten to a vertical seven-sided housing. The assembly having the following dimensions:

| | | |
|---|---|---|
| Height = | | 5 feet 6 inches |
| Housing (seven-sided) | Vertical side length = | 15 inches |
| | Bottom side length = | 13 inches |
| | Rear side length = | 16 inches |
| | Open top side length = | 5 inches |
| | Open bottom side length = | 11 inches |
| | Width of each side = | 2½ inches |
| Inner Diameter of opening = | | 2½ inches |
| Outer Diameter of opening = | | 2¾ inches |
| Depth of opening = | | 2½ inches |
| Outer Diameter of Male Member = | | 2⅞ inches |
| Diameter of holes of Male Member and Opening = | | 7/16 inches |
| First Zone Guide (4-sided arm) | First arm length = | 15 inches |
| | Width of each side of first arm = | 1½ inches |
| | First Flap length = | 13 inches × 2 |
| | First Flap height = | 4 inches × 2 |
| | First Flap thickness = | ½ inch |
| Second Zone Guide (4-sided arm) | Second arm length = | 15 inches |
| | Width of each side of second arm = | 1½ inches |
| | Second Flap length = | 13 inches × 2 |
| | Second Flap height = | 4 inches × 2 |
| | Second Flap thickness = | ½ inch |
| The baseball bat has the following dimensions: | | |
| Length = | | 34 inches |
| Barrel length = | | 16 inches |
| Barrel width = | | 2½ inches |

In operation, the housing 12 is set at a desired height along the support 11. The desired height of the assembly is determined in part by an individual's height and the desired swing path of the bat. Once set, the housing is shifted forward and tightened using the adjustment handle to set each of the arms in an upward position relative to the ground or floor to accommodate the angle of the bat on its swing path.

The distance between the bottom side of the first flap and the top side of second flap is four inches. The training zone defined between the flaps is set for a baseball bat to be swung between the two flaps wherein the barrel of the bat is slightly below the handle of the bat.

The individual aligns himself or herself next to the assembly so that a realistic baseball swing is aimed at maneuvering the barrel of the bat between the two flaps. The overlapping region is accomplished when the length of the barrel of the baseball bat is directly between the two flaps at a point that correlates to a contact point with a thrown baseball. The individual swings the bat between the two flaps attempting to avoid contacting either flap at any point along the length of the barrel of the bat.

Persons of ordinary skill in the art will recognize that many modifications may be made to the embodiments described above without departing from the broad inventive concept thereof. The embodiments described herein are meant to be illustrative only and should not be taken as limiting the invention, which is defined in the following claims.

I claim:

1. An assembly for training hand/eye coordination comprising:

a fastening member for connecting to a support; and an extension member connected to said fastening member, said extension member comprising at least two arms defining a training zone, attachment means for attaching at least one flap to each arm, said flaps defining said training zone;

the training zone configured to accommodate a baseball bat there through forming an overlapping region of the training zone;

wherein the angle of at least one arm relative to said support is adjustable;

wherein the assembly can be positioned at variable points along the support; and wherein the shape of the flaps contour the shape of the baseball bat so that the outermost edges of the flaps are closer in proximity than the center of the flaps.

2. The assembly of claim 1 further comprising an adjustable connection for connecting said extension member to said fastening member.

3. The assembly of claim 2 wherein said adjustable connection comprises a pivot joint.

4. The assembly of claim 2 wherein said adjustable connection comprises a rotable female opening.

5. The assembly of claim 1 wherein said arms further comprise adjustment knobs configured to position and set each of the flaps at any number of points through a range of motion up to about 200° about hinges that attach said flaps to said arms.

6. The assembly of claim 2 wherein said extension member further comprises a T member for connecting to said adjustable connection.

7. The assembly of claim 6 wherein said T member further comprises swivel joints at opposing ends of said T member for attachment of said arms to said T member.

8. The assembly of claim 7 wherein said arms are L-shaped and configured to slide within said T member.

9. The assembly of claim 1 wherein said arms are configured in a non-parallel arrangement.

10. The assembly of claim 1 wherein said flaps are removable.

11. The assembly of claim 7 wherein said training zone can be modified on planes X, Y, and Z relative to said support by varying the orientation of said arms relative to one another as projected out from said support.

12. The assembly of claim 11 wherein said training zone can be further modified on planes X, Y, and Z relative to said support by varying the orientation of said flaps about said arms.

13. The assembly of claim 1 wherein said fastening member is a plate.

14. An assembly for training hand/eye coordination comprising:

a fastening member for connecting to a support;

an extension member connected to said fastening member, said extension member comprising at least two arms defining a training zone;

an adjustable connection for connecting said extension member to said fastening member; and attachment means for attaching at least one flap to each arm, said flaps defining said training zone;

the training zone configured to accommodate a baseball bat there through;

wherein the angle of at least one arm relative to said support is adjustable;

wherein the assembly can be positioned at variable points along the support; and wherein the shape of the flaps contour the shape of the baseball bat so that the outermost edges of the flaps are closer in proximity than the center of the flaps.

15. The assembly of claim 14 wherein said adjustable connection comprises an adjustment spine attached to said fastening member, said adjustment spine being configured so that said extension member can be adjusted along said adjustment spine while said fastening member remains fixed at a point along said support.

16. An assembly for training hand/eye coordination comprising:

a fastening member for connecting to a support, said fastening member configured to pivot about said support;

an extension member connected to said fastening member, said extension member comprising at least two arms defining a training zone;

attachment means for attaching at least one flap to each arm, said flaps defining said training zone; and an adjustable connection comprising a female opening for connecting said extension member to said fastening member, said extension member being rotatable 360° about said fastening member;

wherein the angle of at least one arm relative to said support is adjustable; and wherein the training zone is configured to accommodate a baseball bat therethrough whereby the shape of the flaps contour the shape of the baseball bat so that the outermost edges of the flaps are closer in proximity than the center of the flaps.

17. The assembly of claim 16 wherein at least one arm comprises a training indicator.

* * * * *

UNITED STATES PATENT AND TRADEMARK OFFICE

CERTIFICATE OF CORRECTION

PATENT NO. : 7,300,365 B2
APPLICATION NO. : 11/295039
DATED : November 27, 2007
INVENTOR(S) : Bradford Carter Taylor It is certified that error appears in the above-identified patent and that said Letters Patent is hereby corrected as shown below:

On the title page below item (57) Abstract 11 Drawing Sheets should read 12

In the Drawings:

Figure 12 has been omitted from the issued patent. Please add Figure 12 as follows:

After "Sheet 11 of 11" please insert --Sheet 12 of 12--.

Also, please correct each sheet number to indicate a total of 12 sheets of figures.

For example, "Sheet 1 of 12", "Sheet 2 of 12", etc.

Signed and Sealed this

Sixth Day of May, 2008

JON W. DUDAS
*Director of the United States Patent and Trademark Office*

(12) United States Patent
Taylor

(10) Patent No.: US 7,300,365 B2
(45) Date of Patent: Nov. 27, 2007

(54) ASSEMBLY FOR TRAINING HAND/EYE COORDINATION

(76) Inventor: Bradford Carter Taylor, 16715 Holly Trail Dr., Houston, TX (US) 77058

( * ) Notice: Subject to any disclaimer, the term of this patent is extended or adjusted under 35 U.S.C. 154(b) by 0 days.

(21) Appl. No.: 11/295,039

(22) Filed: Dec. 5, 2005

(65) Prior Publication Data

US 2007/0129182 A1 Jun. 7, 2007

(51) Int. Cl.
*A63B 69/00* (2006.01)

(52) U.S. Cl. ..... 473/451; 473/422; 473/453

(58) Field of Classification Search ..... 473/451, 473/453, 422–430, 454, 417, 419; 434/247; 482/148, 109, 118, 122

See application file for complete search history.

(56) References Cited

U.S. PATENT DOCUMENTS

| | | | | |
|---|---|---|---|---|
| 3,475,026 | A * | 10/1969 | Cooper | 473/430 |
| 3,937,464 | A | 2/1976 | Zalewski | |
| 3,940,131 | A | 2/1976 | St. Claire, Jr. | |
| 3,948,517 | A * | 4/1976 | Feiler | 473/429 |
| 4,451,036 | A * | 5/1984 | Sinclair et al. | 473/453 |
| 4,516,771 | A * | 5/1985 | Nau | 473/453 |
| 4,620,701 | A * | 11/1986 | Mojden | 482/41 |
| 4,655,452 | A * | 4/1987 | Buerstel | 473/453 |
| 4,783,070 | A * | 11/1988 | Bauer et al. | 473/453 |
| 5,087,039 | A | 2/1992 | Laseke | |
| 5,226,645 | A * | 7/1993 | Stewart | 473/453 |
| 5,352,170 | A * | 10/1994 | Condo et al. | 482/83 |
| 5,478,070 | A | 12/1995 | Morrison | |
| 5,485,993 | A * | 1/1996 | Lipsett | 473/448 |
| 5,711,726 | A * | 1/1998 | Powers | 473/453 |
| 6,113,265 | A * | 9/2000 | Babler | 378/197 |
| 6,256,374 | B1 * | 7/2001 | Tomasetti et al. | 378/98.2 |
| 6,435,990 | B1 | 8/2002 | Bradley | |
| 6,695,270 | B1 * | 2/2004 | Smed | 248/274.1 |
| 7,056,237 | B2 * | 6/2006 | Slavey et al. | 473/433 |
| 2003/0220177 | A1 | 11/2003 | Orlando | |
| 2004/0121861 | A1 | 6/2004 | Constant | |
| 2006/0089212 | A1 * | 4/2006 | Marchel | 473/422 |
| 2006/0148597 | A1 * | 7/2006 | Pope et al. | 473/453 |
| 2006/0240917 | A1 * | 10/2006 | Campbell et al. | 473/453 |

* cited by examiner

*Primary Examiner*—Mitra Aryanpour
(74) *Attorney, Agent, or Firm*—Scott D. Compton

(57) ABSTRACT

An assembly for training the hand/eye coordination of an individual. The assembly comprises an unobstructed region where an individual maneuvers a training member through the unobstructed region.

17 Claims, 12 Drawing Sheets

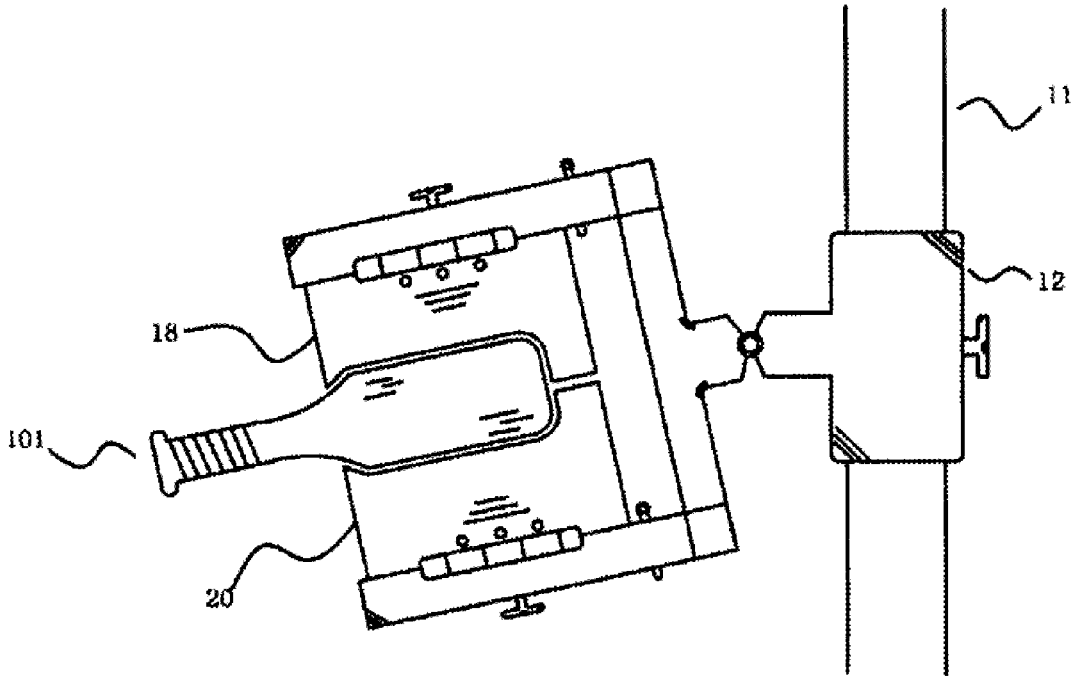

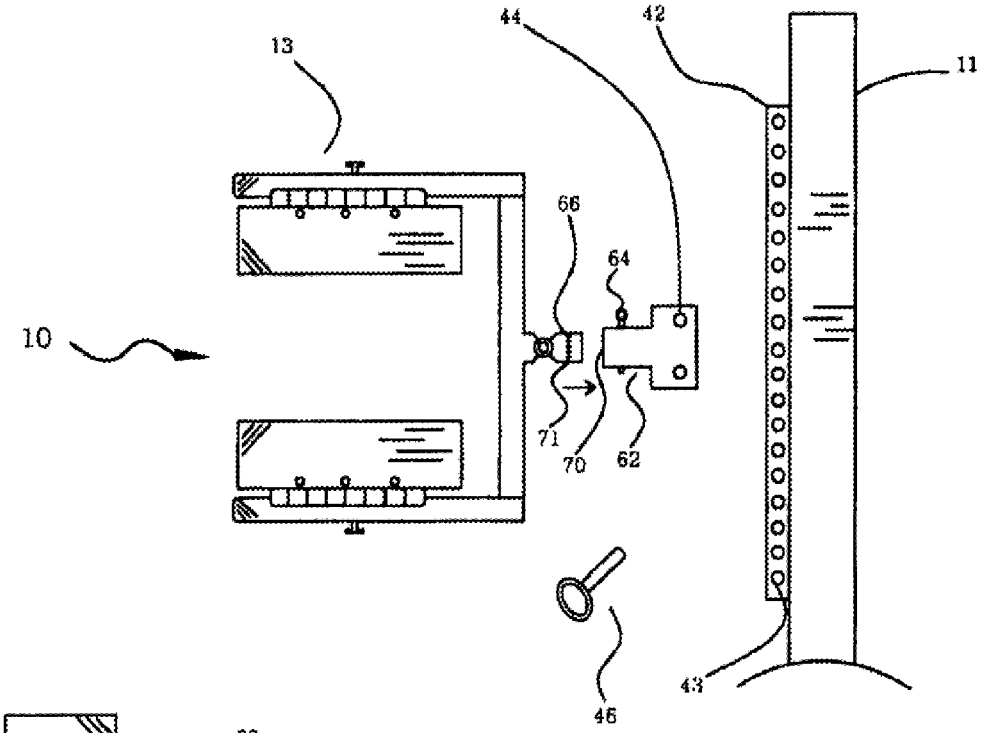
FIG 11A
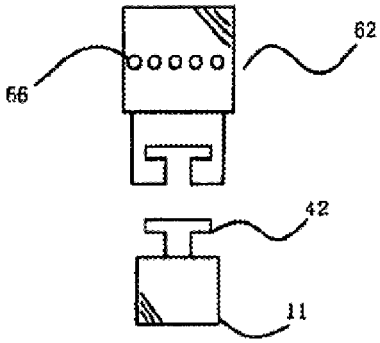
FIG 11B
FIG. 11